US010304430B2

(12) United States Patent
Nakamura

(10) Patent No.: US 10,304,430 B2
(45) Date of Patent: May 28, 2019

(54) ELECTRONIC MUSICAL INSTRUMENT, CONTROL METHOD THEREOF, AND STORAGE MEDIUM

(71) Applicant: CASIO COMPUTER CO., LTD., Tokyo (JP)

(72) Inventor: Atsushi Nakamura, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/923,369

(22) Filed: Mar. 16, 2018

(65) Prior Publication Data

US 2018/0277075 A1 Sep. 27, 2018

(30) Foreign Application Priority Data

Mar. 23, 2017 (JP) ..... 2017-057257

(51) Int. Cl.
*G10H 1/00* (2006.01)
*G10H 1/46* (2006.01)
*G10H 1/34* (2006.01)

(52) U.S. Cl.
CPC ..... *G10H 1/0008* (2013.01); *G10H 1/344* (2013.01); *G10H 1/46* (2013.01); *G10H 2210/005* (2013.01); *G10H 2220/011* (2013.01); *G10H 2240/031* (2013.01); *G10H 2250/455* (2013.01)

(58) Field of Classification Search
CPC ..... G10H 1/0008
USPC ..... 84/609
See application file for complete search history.

(56) References Cited

U.S. PATENT DOCUMENTS 4,527,274 A * 7/1985 Gaynor ..... G10L 13/02 704/260
4,731,847 A * 3/1988 Lybrook ..... G10H 5/005 704/260
5,194,683 A * 3/1993 Tsumura ..... G10H 1/26 369/70

(Continued)

FOREIGN PATENT DOCUMENTS

JP S63-25698 A 2/1988
JP H10-240244 A 9/1998

(Continued)

OTHER PUBLICATIONS

Japanese Office Action dated Jun. 12, 2018, in a counterpart Japanese patent application 2017-057257, (A machine translation (not reviewed for accuracy) attached.).

*Primary Examiner* — David S Warren
(74) *Attorney, Agent, or Firm* — Chen Yoshimura LLP

(57) ABSTRACT

An electronic musical instrument includes; a plurality of keys, each of the plurality of keys specifying a pitch; a memory storing musical piece data representing a musical piece; and a processor, wherein the processor executes the following: retrieving the musical piece data of a musical piece from the memory and determining whether the musical piece data contains data of a lyric; and when the musical piece data contains the data of the lyric, and if a note specified by an operation of a key by a user is accompanied by a part of the lyric in the musical piece, causing data of a singing voice sound having the pitch specified by said operated key to be generated in accordance with the part of the lyric in response to the operation of the key, and causing the singing voice sound to be audibly output.

10 Claims, 12 Drawing Sheets

(56) References Cited

U.S. PATENT DOCUMENTS 5,895,449 A * 4/1999 Nakajima ..... G10H 7/002 704/258
6,191,349 B1 * 2/2001 Flam ..... G10H 1/0066 84/609
6,992,245 B2 * 1/2006 Kenmochi ..... G10H 7/002 704/E13.002
7,241,947 B2 * 7/2007 Kobayashi ..... G10L 13/033 704/268
7,915,511 B2 * 3/2011 Korst ..... G10H 1/0008 84/609
8,465,366 B2 * 6/2013 Applewhite ..... G10H 1/368 463/36
8,604,327 B2 * 12/2013 Takeda ..... G10H 1/0008 434/307 A
9,401,941 B2 * 7/2016 Juristovski ..... G10H 1/365
9,754,572 B2 * 9/2017 Salazar ..... G10H 1/366
9,852,742 B2 * 12/2017 Cook ..... G10H 1/366
10,002,604 B2 * 6/2018 Kayama ..... G10L 13/08
2003/0221542 A1 * 12/2003 Kenmochi ..... G10H 7/002 84/616
2004/0186720 A1 * 9/2004 Kemmochi ..... G10H 5/00 704/258
2004/0231499 A1 11/2004 Kobayashi
2008/0115655 A1 * 5/2008 Weng ..... G10H 1/0008 84/609
2009/0173215 A1 * 7/2009 Reynolds ..... G09B 15/00 84/612
2010/0304863 A1 * 12/2010 Applewhite ..... G10H 1/368 463/36
2012/0079384 A1 * 3/2012 Chuang ..... G10H 1/0008 715/716
2012/0118127 A1 * 5/2012 Miyajima ..... G10H 1/0025 84/612
2012/0221975 A1 * 8/2012 Juristovski ..... G10H 1/365 715/823
2014/0006031 A1 * 1/2014 Mizuguchi ..... G10L 13/04 704/260
2014/0136207 A1 * 5/2014 Kayama ..... G10L 13/08 704/258
2015/0170636 A1 * 6/2015 Cook ..... G10H 1/366 704/268
2015/0188958 A1 * 7/2015 Juristovski ..... G10H 1/365 715/753
2016/0111083 A1 * 4/2016 Iriyama ..... G10L 13/0335 704/267
2017/0011725 A1 * 1/2017 Reynolds ..... G09B 15/00
2017/0169806 A1 * 6/2017 Hamano ..... G10G 1/00
2018/0099840 A1 * 4/2018 Armistead ..... G05B 19/042
2018/0105390 A1 * 4/2018 Salmikuukka ..... B66B 3/008
2018/0182199 A1 * 6/2018 Yamine ..... G07C 9/00896
2018/0273346 A1 * 9/2018 Hwang ..... B66B 5/0012
2018/0277080 A1 * 9/2018 Nakamura ..... G10H 1/34
2018/0287970 A1 * 10/2018 Baldi ..... H04L 51/04
2018/0342228 A1 * 11/2018 Wei ..... G09B 15/023
2018/0362296 A1 * 12/2018 Friedli ..... B66B 5/0012
2018/0366097 A1 * 12/2018 Sharp ..... G10H 1/361
2019/0002234 A1 * 1/2019 Shinohe ..... B66B 1/2408
2019/0012864 A1 * 1/2019 Yamine ..... G07C 9/00896

FOREIGN PATENT DOCUMENTS

JP 2000-010556 A 1/2000
JP 2001-083975 A 3/2001
JP 2001-215979 A 8/2001
JP 3858842 B2 12/2006
JP 4305084 B2 7/2009
JP 2015-081981 A 4/2015
WO WO-2018214264 A1 * 11/2018 ..... G09B 15/023

* cited by examiner

ELECTRONIC MUSICAL INSTRUMENT, CONTROL METHOD THEREOF, AND STORAGE MEDIUM

BACKGROUND OF THE INVENTION

Field of the Invention

The present invention relates to an electronic musical instrument, a control method thereof, and a storage medium.

Description of Related Art

Conventionally, electronic keyboard musical instruments are known which have a key operation guide function via light using a light-generating function of keys and which further include: a key pressing pre-notification timing acquisition means that, for a pressing instruction key for which key pressing should be indicated, acquires a key pressing pre-notification timing that is prior to a key pressing timing at which the key should be pressed; and a light emitting control means that, for the pressing instruction key, starts light emitting at the key pressing notification timing acquired by the key pressing notification timing acquisition means and modifies the light-emitting mode after the key pressing timing (see Patent Document 1).

Patent Document 1: Japanese Patent Application Laid-Open Publication No. 2015-081981

There are many musical pieces accompany lyrics that match the musical piece, and it is possible to enjoyably carry out practicing and the like of the electronic musical instrument if a singing voice is played as the performance of the electronic musical instrument progresses.

Meanwhile, there is a problem in that, even if an electronic musical instrument is configured such that the singing voice (hereafter also referred to as a lyrical sound) is output in sync with the performance of the electronic musical instrument, when the volume of the sound of the electronic musical instrument (hereafter also referred to as an accompaniment sound and a musical instrument sound) becomes large, the lyrical sound becomes difficult to hear.

In addition, there are some musical pieces which do not include lyrics corresponding to specified pitches. Thus, there is a problem in that, if the lyrics simply move forward every time a performer specifies the pitch via operating elements, the lyrics will move ahead faster than the performer desires and it is not possible to provide an electronic musical instrument that plays a song well.

SUMMARY OF THE INVENTION

The present invention was made in view of the above-mentioned circumstances, and according to one aspect of the present invention, it is possible to provide an electronic musical instrument or the like that plays a song well.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument, including: a plurality of keys, each of the plurality of keys specifying a pitch; a memory storing musical piece data representing a musical piece; and a processor, wherein that processor executes the following: receiving a signal indicating an operation of a key, among the plurality of keys, by a user in a timing corresponding to a note in the musical piece; retrieving the musical piece data of the musical piece from the memory and determining whether the musical piece data contains data of a lyric; when the musical piece data does not contain the data of the lyric, causing data of a musical instrument sound having a pitch specified by that operated key to be generated in response to the operation of the key, and causing the musical instrument sound to be audibly output; and when the musical piece data contains the data of the lyric, and if that note in the musical piece is accompanied by a part of the lyric, causing data of a singing voice sound having the pitch specified by that operated key to be generated in accordance with the part of the lyric in response to the operation of the key, and causing the singing voice sound to be audibly output.

In another aspect, the present disclosure provides a method performed by a processor in an electronic musical instrument that includes: that processor; a plurality of keys, each of the plurality of keys specifying a pitch; and a memory storing musical piece data representing a musical piece, the method including: receiving a signal indicating an operation of a key, among the plurality of keys, by a user in a timing corresponding to a note in the musical piece; retrieving the musical piece data of the musical piece from the memory and determining whether the musical piece data contains data of a lyric; when the musical piece data does not contain the data of the lyric, causing data of a musical instrument sound having a pitch specified by that operated key to be generated in response to the operation of the key, and causing the musical instrument sound to be audibly output; and when the musical piece data contains the data of the lyric, and if that note in the musical piece is accompanied by a part of the lyric, causing data of a singing voice sound having the pitch specified by that operated key to be generated in accordance with the part of the lyric in response to the operation of the key, and causing the singing voice sound to be audibly output.

In another aspect, the present disclosure provides a non-transitory computer-readable storage medium having stored thereon a program executable by a processor in an electronic musical instrument, the electronic musical instrument including: that processor, a plurality of keys, each of the plurality of keys specifying a pitch; and a memory storing musical piece data representing a musical piece, the program causing the processor to perform the following: receiving a signal indicating an operation of a key, among the plurality of keys, by a user in a timing corresponding to a note in the musical piece; retrieving the musical piece data of the musical piece from the memory and determining whether the musical piece data contains data of a lyric; when the musical piece data does not contain the data of the lyric, causing data of a musical instrument sound having a pitch specified by that operated key to be generated in response to the operation of the key, and causing the musical instrument sound to be audibly output; and when the musical piece data contains the data of the lyric, and if that note in the musical piece is accompanied by a part of the lyric, causing data of a singing voice sound having the pitch specified by that operated key to be generated in accordance with the part of the lyric in response to the operation of the key, and causing the singing voice sound to be audibly output.

It is to be understood that both the foregoing general description and the following detailed description are exemplary and explanatory, and are intended to provide further explanation of the invention as claimed.

BRIEF DESCRIPTION OF THE DRAWINGS

A deeper understanding of the present application can be obtained by referring to the drawings described below alongside the detailed description given below.

DETAILED DESCRIPTION OF EMBODIMENTS

Embodiment 1

An electronic musical instrument 1 according to Embodiment 1 of the present invention will be described below with reference to the attached drawings.

In the embodiments below, the electronic musical instrument 1 will be specifically described as an aspect that is a keyboard musical instrument; however, the electronic musical instrument 1 of the present invention is not limited to a keyboard musical instrument.

Figure 1:
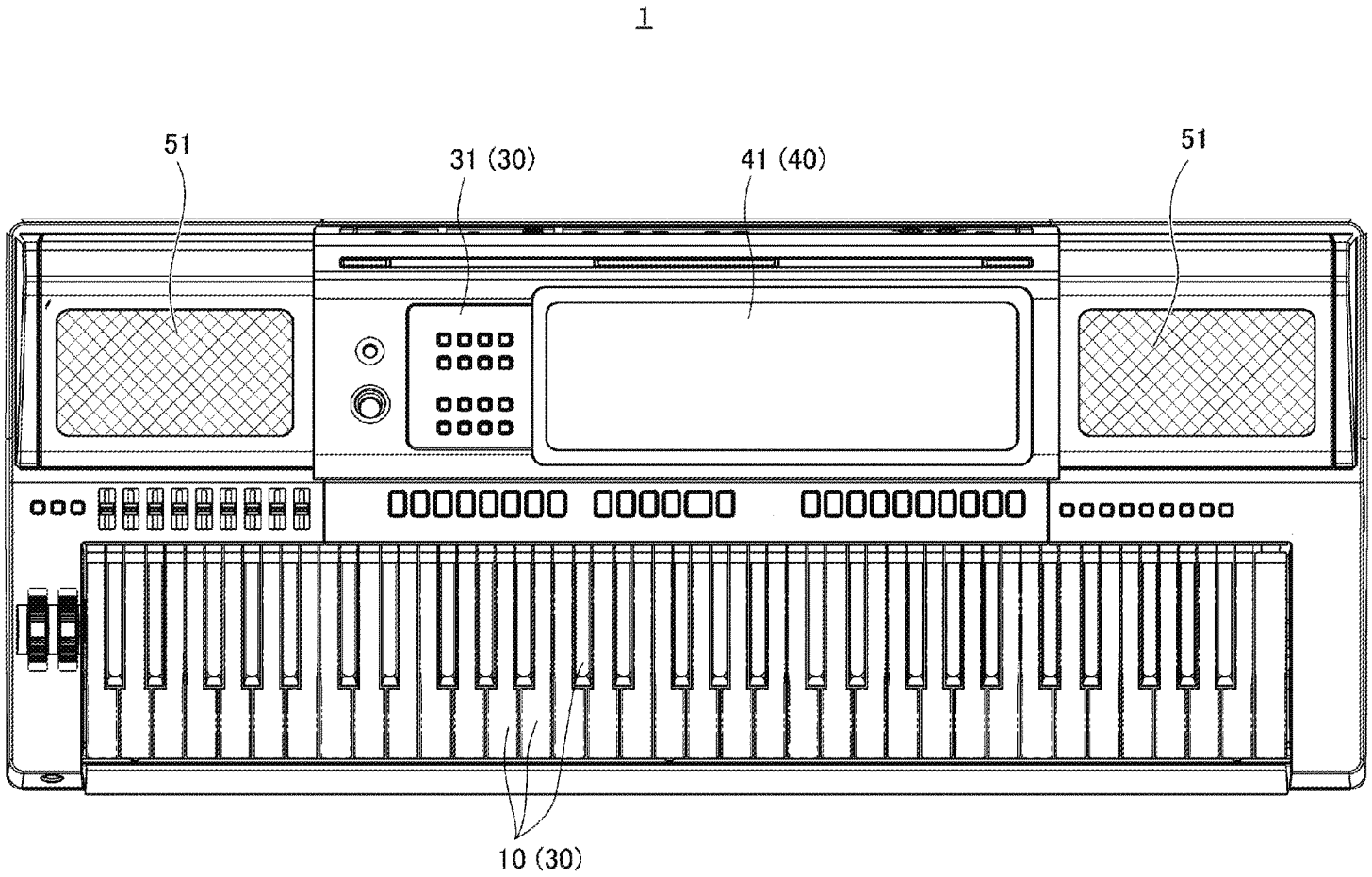
FIG. 1 is a plan view of an electronic musical instrument according to Embodiment 1 of the present invention.
Figure 2:
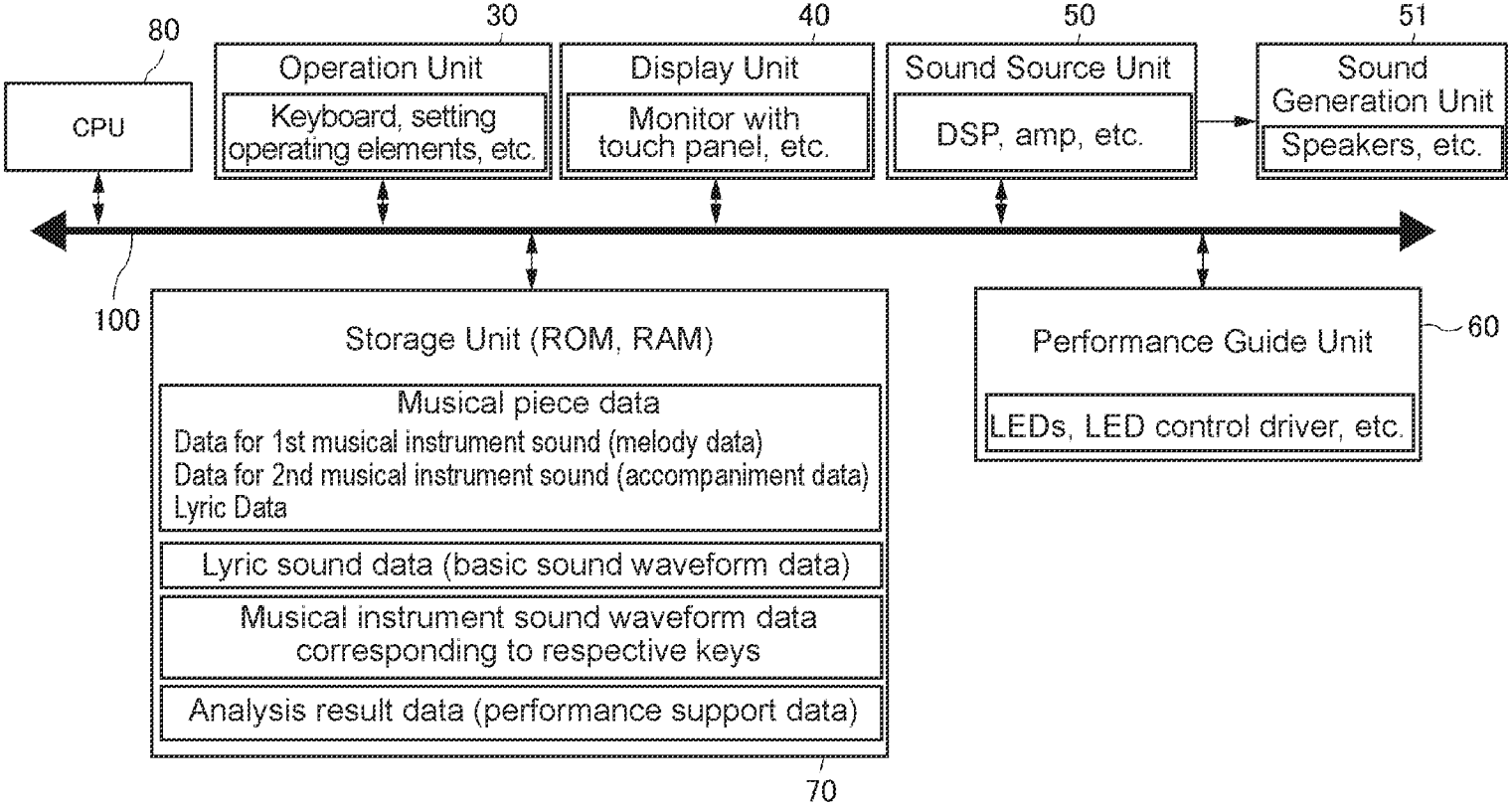
FIG. 2 is a block diagram of the electronic musical instrument according to Embodiment 1 of the present invention.
Figure 3:
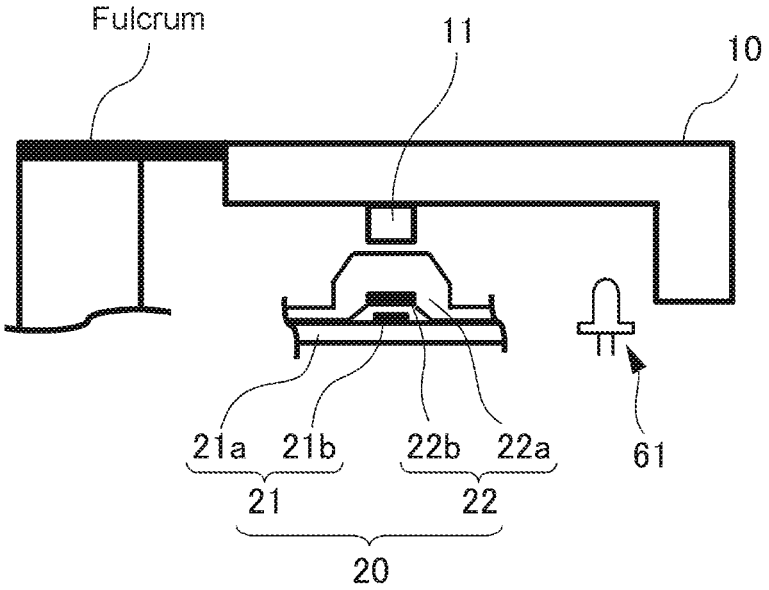
FIG. 3 is a partial cross-sectional side view that shows a key according to Embodiment 1 of the present invention.

FIG. 1 is a plan view of the electronic musical instrument 1 of Embodiment 1, FIG. 2 is a block diagram of the electronic musical instrument 1, and FIG. 3 is a partial cross-sectional side view that shows a key 10.

As shown in FIG. 1, the electronic musical instrument 1 according to the present embodiment is an electronic keyboard musical instrument that has a keyboard, such as an electronic piano, synthesizer, electronic organ, or the like. The electronic musical instrument 1 includes: a plurality of keys 10; an operation panel 31; a display panel 41; and a sound generation unit 51.

In addition, as shown in FIG. 2, the electronic musical instrument 1 further includes: an operation unit 30; a display unit 40; a sound source unit 50; a performance guide unit 60; a storage unit 70; and a CPU 80.

The operation unit 30 includes: a plurality of the keys 10; a key pressing detection unit 20; and the operation panel 31.

The keys 10 are parts that function as an input unit for carrying out sound generation and muting instructions to the electronic musical instrument 1 when a performer is performing.

The key pressing detection unit 20 is a part that detects the keys 10 being pressed, and as shown in FIG. 3, has a rubber switch.

Specifically, the key pressing detection unit 20 includes: a circuit board 21 in which a switch contact 21*b* in the shape of comb, for example, is provided on a board 21*a*; and a dome rubber 22 disposed on the circuit board 21.

The dome rubber 22 includes: a dome section 22*a* disposed so as to cover the switch contact 21*b*; and a carbon surface 22*b* provided on a surface of the dome section 22*a* facing the switch contact 21*b*.

When the performer presses the key 10, the key 10 moves toward the dome section 22*a* about a fulcrum, causing a protrusion 11 provided in a location of the key 10 facing the dome section 22*a* to press the dome section 22*a* toward the circuit board 21, and the buckled dome section 22*a* brings the carbon surface 22*b* to contact with the switch contact 21*b*.

When this happens, the switch contact 21*b* short circuits, the switch contact 21*b* becomes conductive, and pressing of the key 10 is detected.

Conversely when the performer stops pressing the key 10, in conjunction with the key 10 returning to the pre-pressing state shown in FIG. 3, the dome section 22*a* returns to the original state thereof, and the carbon surface 22*b* separates from the switch contact 21*b*.

When this happens, the switch contact 21*b* stops being conductive, and the separation of the key 10 is detected.

The key pressing detection unit 20 is disposed so as to correspond to the respective keys 10.

In addition, while omitted from the drawings and the description, the key pressing detection unit 20 of the present embodiment further includes a function for detecting a key pressing velocity that is the strength of the pressing of the key 10 (a function that specifies the key pressing velocity in accordance with pressure detection of a pressure sensor, for example).

However, the function that detects the key pressing velocity is not limited to being realized via a pressure sensor, and may be configured so as to detect the key pressing velocity by providing a plurality of electrically-independent contacts as the switch contact 21*b* and obtaining the movement speed of the key 10 via a time difference at which the respective contacts short circuit or the like.

The operation panel 31 has operation buttons where the performer performs various types of setting and the like, and is a part for selecting use/not-use practice mode, selecting the type of practice mode to be used, performing various types of setting operations such as volume adjustment, and the like, for example.

The display unit 40 has the display panel 41 (a liquid crystal monitor with a touch panel, for example), and is a part for performing display of messages accompanying the operation of operation panel 31 by the performer, display for selecting the practice mode, which will be explained later, and the like.

In the present embodiment, the display unit 40 has a touch panel function; thus, the display unit 40 is able to serve as a part of the operation unit 30.

The sound source unit 50 is a part that causes sound to be output from the sound generation unit 51 (speakers and the like) in accordance with instruction from the CPU 80, and has a DSP (digital signal processor) and an amp.

The performance guide unit 60 will be explained later, but is a part for visually showing the keys 10 that the performer should press when a practice mode is selected.

Thus, as shown in FIG. 3, the performance guide unit 60 of the present embodiment includes: LEDs 61; and an LED controller driver that controls the turning ON and turning OFF of the LEDs 61 and the like.

The LEDs 61 are provided so as to correspond to the respective keys 10, and a portion of the keys 10 facing the LEDs 61 is configured such that light is able to pass therethrough.

The storage unit 70 includes: ROM that is memory used exclusively for reading; and RAM that is memory that is able to read and write.

Furthermore, in addition to control programs for performing overall control of the electronic musical instrument 1, musical piece data (including data for first musical instrument sound, lyric data, data for second musical instrument sound, and the like, for example), data for lyrical sound (basic sound waveform data), musical instrument sound waveform data corresponding to the keys 10, and the like are stored in the storage unit 70, with data and the like (such as analysis result data, for example) generated during the process of the CPU 80 performing control in accordance with the control programs also being stored therein.

Data for a plurality of musical pieces corresponding to musical pieces that the performer can select is stored in the storage unit 70, and the musical instrument sound waveform data corresponding to the keys 10 may be stored in the sound source unit 50.

The data for the first musical instrument sound is melody data included in the musical piece data corresponding to the melody part performed using the right hand, and, as will be mentioned later, includes data and the like for guiding the performer such that the performer can operate (pressing and releasing) the correct keys 10 at the correct timing during right hand practice in which the performance (melody performance) of the right hand is practiced.

Specifically, the data for the first musical instrument sound has data series in which individual data (hereafter also referred to as first musical instrument sound data) corresponding to the order of the keys 10 operated by the performer from the beginning to the end of the performance is sequentially arranged in accordance with the order of the sequence of the notes corresponding to the musical sounds of the melody part.

In addition, each of the first musical instrument sound data includes: information of the corresponding key 10; timing (a note-ON timing and a note-OFF timing) at which the key 10 should be pressed and released in accordance with the progression of the data for the second musical instrument sound (accompaniment data, which will be explained later); and a first pitch, which is pitch information for the sound (hereafter also referred to as a first musical instrument sound) of the corresponding key 10.

The sounds of the corresponding keys 10 (first musical instrument sounds) described here are respectively the sounds of the notes of the musical sound of the melody part, which are the first musical instrument sound data (individual data of the data for the first musical instrument sound) included in the musical piece data; thus, simply put, the first pitch corresponds to the pitch of the note of the melody part included in the musical piece data.

Meanwhile, hereafter, in order to distinguish from the first pitch that is the pitch of the note of the melody part included in the musical piece data, a pitch that is not the pitch of the note of the melody part included in the musical piece data is referred to as a second pitch.

In addition, in order to be able to realize auto-play with which the melody performance is automatically performed, the first musical instrument sound data also includes information related to things such as which musical instrument sound waveform data, from among the musical instrument sound waveform data that corresponds to the respective keys 10 (which will be described later) will be used when sound is generated.

The musical instrument sound waveform data corresponding to the first musical instrument sound data, or in other words, the musical instrument sound waveform data of the melody part, is referred to as the first musical instrument sound waveform data.

The lyric data has data series in which individual data (hereafter also referred to as lyrical data) corresponding to the respective first musical instrument sound data is sequentially arranged.

Furthermore, the respective lyrical data includes information related to things such as which basic sound waveform data, from among the data for lyrical sound in which the basic sound waveform data corresponding to the voice sound of the singing voice, which will explained later, is stored, will be used in order to cause the sound generation unit 51 to generate a singing voice and the first musical instrument sound corresponding to the pressed keys 10 when the keys 10 corresponding to the respective first musical instrument sound data are pressed.

The data for the second musical instrument sound is accompaniment data included in the musical piece data corresponding to the accompaniment part performed using the left hand, and, as will be explained later, includes data for guiding the performer such that the performer can operate (press and release) the correct keys 10 at the correct timing during left hand practice in which the performance (accompaniment performance) using the left hand is practiced, and the like.

Specifically, as for the data for the first musical instrument sound, the data for the second musical instrument sound has data series in which individual data (hereafter also referred to as second musical instrument sound data) corresponding to the order of the keys 10 operated by the performer from the beginning to the end of the performance is sequentially arranged in accordance with the order of the sequence of the notes corresponding to the musical sounds of the accompaniment part.

In addition, each of the data for the second musical instrument sound includes: information of the corresponding key 10; timing (a note-ON and a note-OFF timing) at which the key should be pressed and released; and a third pitch, which is pitch information for the sound (hereafter referred to as the second musical instrument sound) of the corresponding key 10.

The sounds of the corresponding keys 10 (second musical instrument sound) described here are respectively the sounds of the notes of the musical sound of the accompaniment part, which are the second musical instrument sound data (individual data of the data for the second musical instrument sound) included in the musical piece data; thus, simply put, the third pitch corresponds to the pitch of the note of the accompaniment part included in the musical piece data.

In addition, in order to be able to realize auto-play with which the melody performance is automatically performed, the second musical instrument sound data includes information related to things such as which musical instrument sound waveform data, from among the musical instrument sound waveform data corresponding to the respective keys 10 (which will be described later) will be used when sound is generated.

The musical instrument sound waveform data corresponding to the second musical instrument sound data, or in other words, the musical instrument sound waveform data of the accompaniment part, is referred to as the second musical instrument sound waveform data.

The data for lyrical sound includes basic sound waveform data that corresponds to the respective voice sounds of the singing voices for causing voice sounds corresponding to singing voices to be generated by the sound generation unit 51.

In the present embodiment, voice sound waveforms in which the pitch has been normalized are used as basic sound waveform data (basic voice sound waveform data). In order to generate a singing voice from the sound generation unit 51, the CPU 80 that functions as a control unit generates singing voice waveform data based on the basic voice sound waveform data and the first pitch specified by the melody part, and outputs the resulting singing voice waveform data to the sound source unit 50.

The sound source unit 50 then causes a singing voice to be generated from the sound generation unit 51 in accordance with this output singing voice waveform data.

Meanwhile, the musical piece data including the above-mentioned data for the first musical instrument sound, lyric data, data for the second musical instrument sound, and the like is also used as guide data so that, during two hand practice in which the performer practices a performance using two hands, or in other words, practices both the melody performance performed using the right hand and the accompaniment performance performed using the left hand, the performer is able to operate (press and release) the correct keys 10 at the correct timing.

The analysis result data (will be explained in more detail later) is data created by analyzing the data for the first musical instrument sound and includes information necessary to generate easy-to-hear singing voices from the sound generation unit 51 based on the singing voice waveform data. For example, the analysis result data includes data series in which individual data (hereafter also referred to as data for analysis results), corresponding to the order of the keys 10 (the keys 10 corresponding to the first musical instrument sound) that the performer operates using the right hand from the beginning to the end of the performance, is sequentially arranged.

The musical instrument sound waveform data corresponding to the respective keys 10 is data output to the sound source unit 50 in order for the CPU 80 functioning as the control unit to generate musical instrument sounds from the sound generation unit 51 when the keys 10 are pressed.

Then, when the performer presses the key 10, the CPU 80 sets a note command (note-ON command) for the pressed key 10, and when the note command (note-ON command) is output (sent) to the sound source unit 50, the sound source unit 50 that received the note command (note-ON command) causes the sound generation unit 51 to generate sound in accordance with the note command (note-ON command).

The CPU 80 is a part that is in charge of controlling the entire electronic musical instrument 1.

In addition, the CPU 80 performs control that generates a musical sound in accordance with the pressing of the key 10 from the sound generation unit 51 via the sound source unit 50, control that mutes the generated musical sound in accordance with the release of the key 10, and the like, for example.

Furthermore, during practice mode, which will be explained later, the CPU 80 performs control that causes the LED controller/driver to turn the LEDs 61 ON and OFF in accordance with data used during practice mode, and the like.

In addition, the above-described respective units (the operation unit 30, the display unit 40, the sound source unit 50, the performance guide unit 60, the storage unit 70, and the CPU 80) are connected via a bus 100 so as to be able to communicate, and are configured such that necessary data exchange can be carried out between the units.

Next, the practice modes included in the electronic musical instrument 1 will be described.

The practice modes included in the electronic musical instrument 1 include: a right hand practice mode (a melody practice mode); a left hand practice mode (an accompaniment practice mode); and a two hand practice mode (a melody and accompaniment practice mode).

When a user selects any of the practice modes and selects a musical piece to perform, the selected practice mode is executed.

The right hand practice mode is a practice mode that guides the user to press keys 10 by turning ON the LEDs 61 when the keys 10 that should be pressed should be pressed for the melody part performed using the right hand, guides the user to release the keys by turning OFF the LEDs 61 when the pressed keys 10 are to be released, auto-plays the accompaniment part played by the left hand, and outputs a singing voice in accordance with the melody.

The left hand practice mode is a practice mode that guides the user to press keys by turning ON the LEDs 61 when the keys 10 that should be pressed should be pressed for the accompaniment part performed using the left hand, guides the user to release the keys by turning OFF the LEDs 61 when the pressed keys 10 are to be released, auto-plays the melody part played by the right hand, and outputs the singing voice in accordance with the melody.

The two hand practice mode is a practice mode that guides the user to press keys by turning ON the LEDs 61 when the keys 10 that should be pressed should be pressed for the melody part performed using the right hand and for the accompaniment part performed using the left hand, guides the user to release the keys by turning OFF the LEDs 61 when the pressed keys 10 are to be released, and additionally outputs the singing voice in accordance with the melody.

The specific processing order of the CPU 80 and the sound source unit 50 (DSP) that realize such practice modes will be described below while referencing FIGS. 4 to 7.

Figure 4:
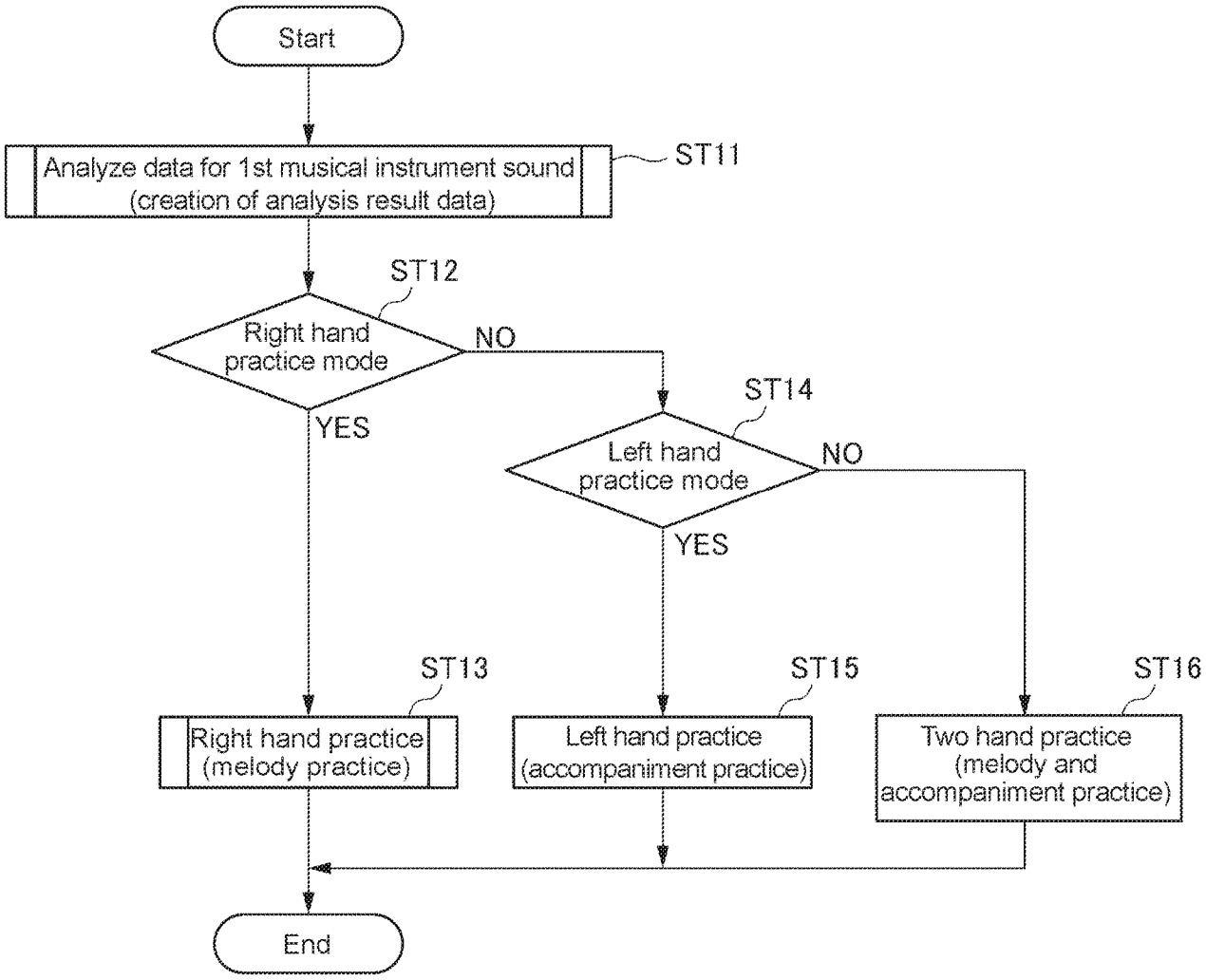
FIG. 4 is a flow chart showing a main routine of a practice mode executed by a CPU according to Embodiment 1 of the present invention.
Figure 5:
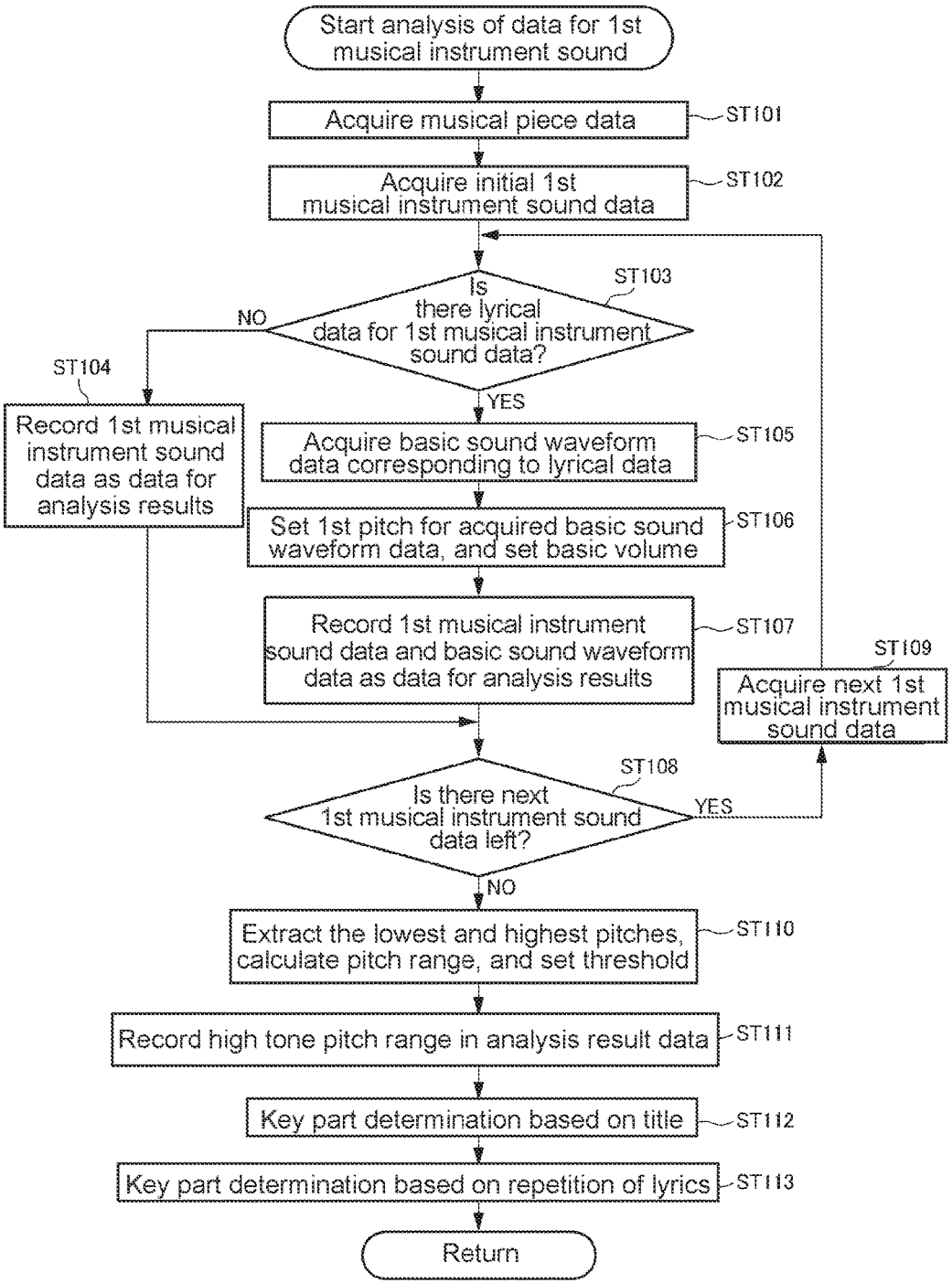
FIG. 5 is a flow chart of data analysis for the first musical instrument sound, which is a subroutine of the practice mode executed by the CPU according to Embodiment 1 of the present invention.
Figure 6:
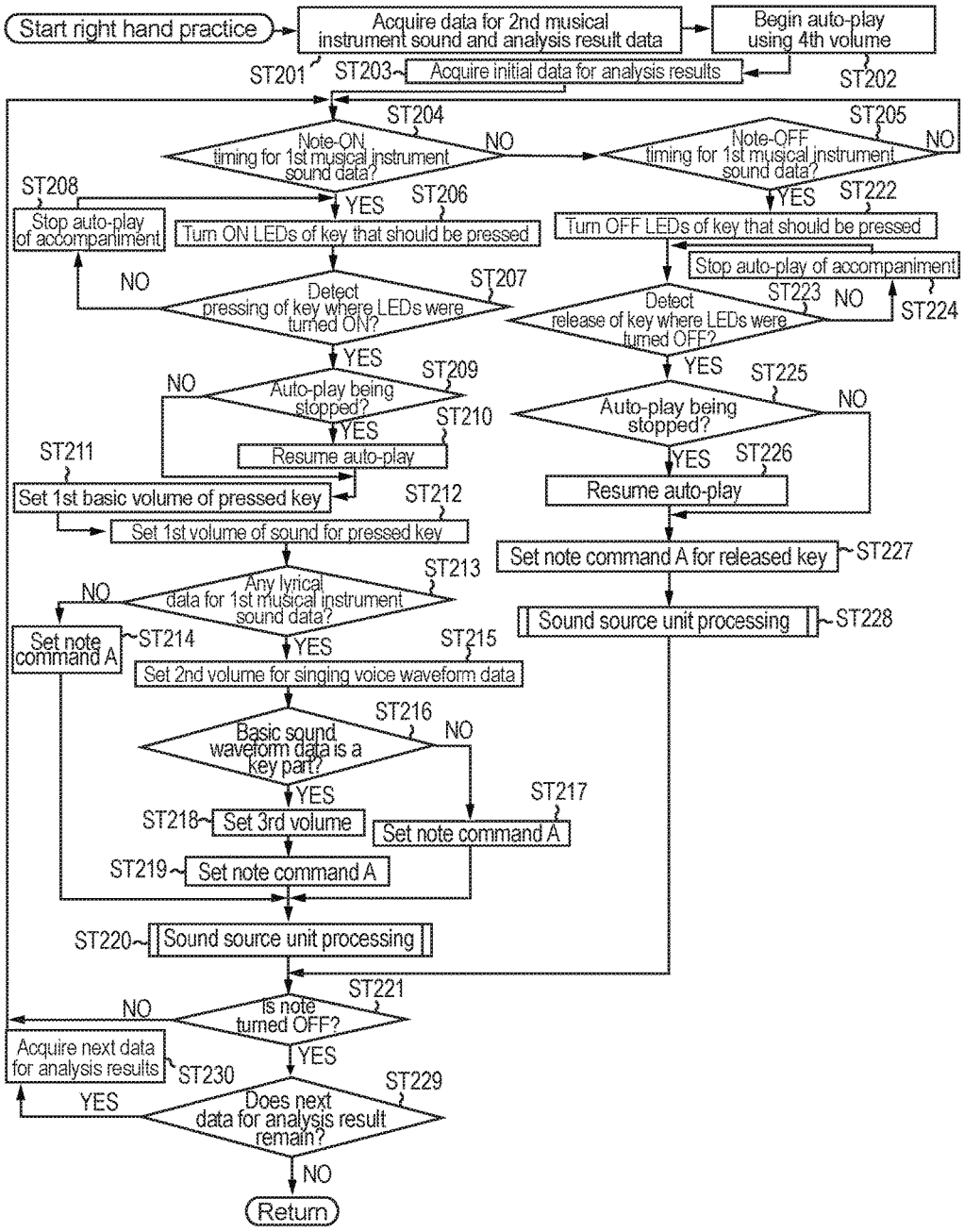
FIG. 6 is a flow chart of right hand practice, which is a subroutine of a right hand practice mode executed by the CPU according to Embodiment 1 of the present invention.
Figure 7:
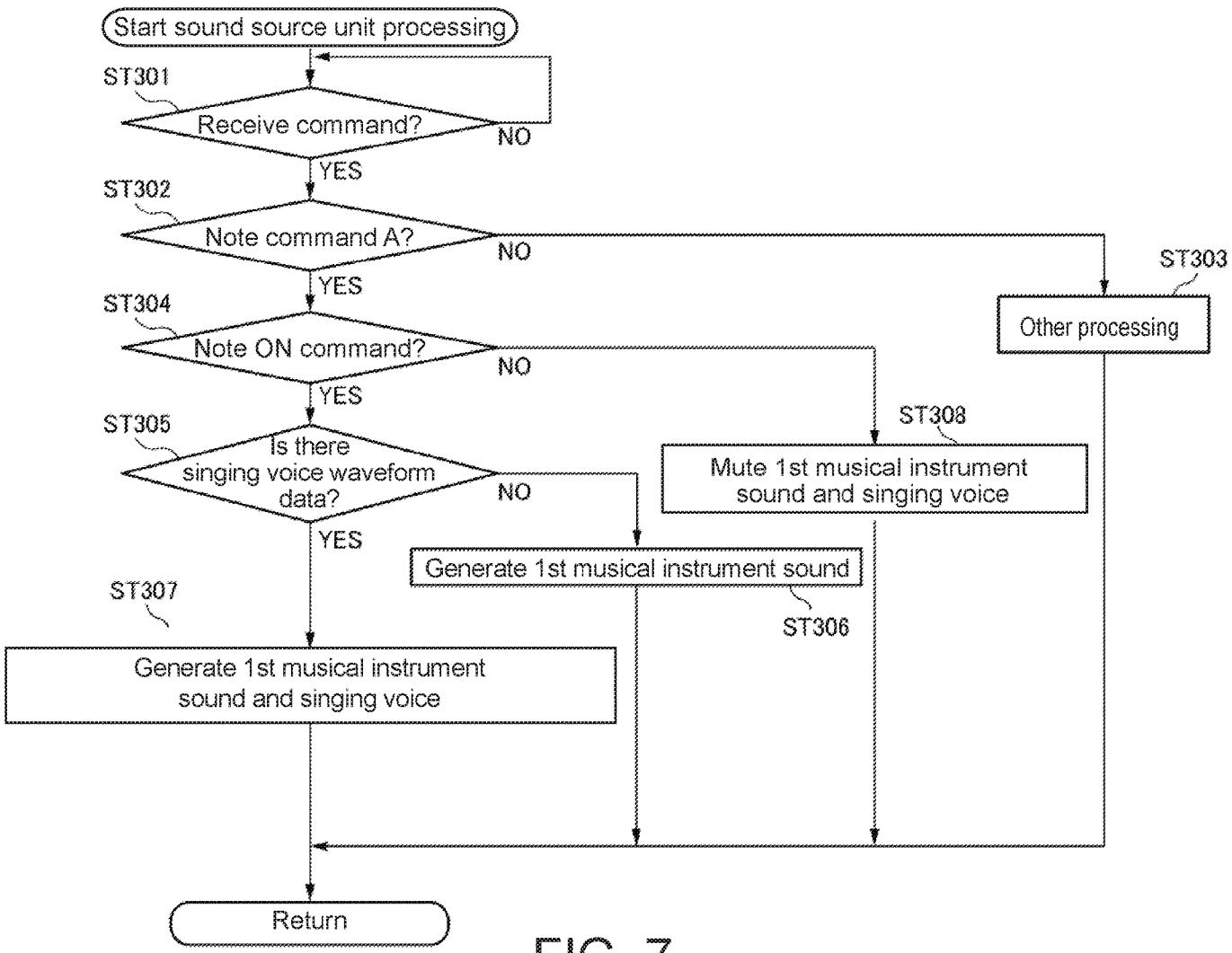
FIG. 7 is a flow chart of sound source unit processing executed by a sound source unit according to Embodiment 1 of the present invention.

FIG. 4 is a flow chart showing a main routine of the practice modes executed by the CPU 80, FIG. 5 is a flow chart of data analysis for the first musical instrument sound, which is a subroutine of the practice modes executed by the CPU 80, FIG. 6 is a flow chart of right hand practice, which is a subroutine of the right hand practice mode executed by the CPU 80, and FIG. 7 is a flow chart of sound source unit processing executed by the sound source unit 50 (DSP).

Once the performer has selected a practice mode and musical piece by operating the operation panel 31 or the like, the CPU 80 starts the main flow processing shown in FIG. 4 when a prescribed starting operation is performed.

As shown in FIG. 4, after the CPU 80 has executed data analysis processing for the first musical instrument sound, which will be explained later, in Step ST11, the CPU 80 determines whether or not the practice mode selected by the performer is the right hand practice mode (Step ST12).

When the Step ST12 determination result is YES, the CPU 80 proceeds to right hand practice processing (Step ST13), which will be explained later. When the determination result is NO, the CPU 80 proceeds to determining whether or not the selected practice mode is the left hand practice mode (Step ST14).

When the Step ST14 determination result is YES, the CPU 80 begins left hand practice processing (Step ST15).

Then, in the left hand practice processing, the musical instrument guides the performer to press keys by turning ON the LEDs 61 when the keys 10 that should be pressed should be pressed for the accompaniment part performed using the left hand, guides the performer to release the keys by turning OFF the LEDs 61 when the pressed keys 10 are to be released, auto-plays the melody part performed using the right hand, and outputs the singing voice in accordance with the melody.

The volumes of the melody, accompaniment, and singing voice during left hand practice are generated from the sound generation unit 51 using the same volume relationship as for the right hand practice, which will be explained later.

When the Step ST14 determination result is NO, the CPU 80 executes the two hand practice mode that is the remaining practice mode.

Specifically, when the Step ST14 determination result is NO, the CPU 80 begins two hand practice processing (Step ST16).

In the two hand practice processing, the musical instrument 1 guides the performer to press keys by turning ON the LEDs 61 when the keys 10 that should be pressed should be pressed for the melody part played using the right hand and the accompaniment part played using the left hand, guides the performer to release keys by turning OFF the LEDs 61 when the pressed keys 10 are to be released, and additionally outputs the singing voice in accordance with the melody.

The volumes of the melody, accompaniment, and singing voice during two hand practice are generated from the sound generation unit 51 using the same volume relationship as for the right hand practice, which will be explained later.

Next, the data analysis processing for the first musical instrument sound that was to be mentioned later and is shown in FIG. 5 will be described.

The data analysis processing for the first musical instrument sound is processing carried out by the CPU 80, and is processing that obtains data for analysis results corresponding to the respective first musical instrument sound data included in the data for the first musical instrument sound, and creates analysis result data that is an aggregate of the respective obtained data for analysis results.

As shown in FIG. 5, the CPU 80, in Step ST101, acquires musical piece data corresponding to the selected musical piece from the storage unit 70, and in Step ST102, acquires the initial first musical instrument sound data in the data for the first musical instrument sound in the musical piece data.

Then, after acquiring the first musical instrument sound data, the CPU 80 in Step ST103 determines whether or not there is lyrical data corresponding to the first musical instrument sound data from the lyric data in the musical piece data. If the Step ST103 determination result is NO, the CPU 80, in Step ST104, records the first musical instrument sound data as data for analysis results that will be one piece of data in the data series of the analysis result data in the storage unit 70.

If the Step ST103 determination result is YES, the CPU 80, in Step ST105, acquires the basic sound waveform data corresponding to the lyrical data from the data for lyrical sound in the storage unit 70.

Then, in Step ST106, the CPU 80 sets a first pitch of the first musical instrument sound data for the pitch of the acquired basic sound waveform data, and sets a basic volume (UV).

Then, in Step ST107, the CPU 80 records the first musical instrument sound data and the basis sound waveform data in which the first pitch and the basic volume (UV) were set so as to correspond to the first musical instrument sound data as data for analysis results that will be one piece of data in the data series of the analysis result data in the storage unit 70.

Once the processing of Step ST104 or Step ST107 has been completed, the CPU 80 determines in Step ST108 whether or not there is next first musical instrument sound data left in the data for the first musical instrument sound.

Then, when the Step ST108 determination result is YES, the CPU 80, in Step ST109, acquires the next first musical instrument sound data from the data for the first musical instrument sound, and thereafter returns to Step ST103 and repeats the processing of Step ST104 or Step ST105 to Step ST107.

When the Step ST108 determination result is NO, the CPU 80, in Step ST110, extracts a lowest pitch and a highest pitch among the first pitches from a plurality of note pitches included in the data for the first musical instrument sound included in the musical piece data, calculates a pitch range, and then sets a threshold based on the pitch range.

Then, in Step ST111, the CPU 80 records a high tone pitch range at or above the threshold in the analysis result data.

For example, the threshold may be set to 90% or higher of the obtained pitch range, or the like.

There are many instances in which a region of a high tone pitch range that is within the pitch range and is at or above the threshold corresponds to a hook of the song, and the recording of the high tone pitch range is used to be reflected in a volume setting, which will be explained later, and the like.

Next, in Step ST112, the CPU 80 executes key part determination processing that determines (calculates), from the lyric data included in the musical piece data, a range of the lyrics that matches the title name, sets that this is a key part in the basic sound waveform data of the analysis result data corresponding to the range of the lyrics that matches the title name determined to be a key part, and records this information in the analysis result data.

There are many instances in which the part of the lyrics that matches the title name also corresponds to the hook, and this is reflected in the volume settings, which will be explained later, and the like by setting that this part is a key part.

Furthermore, in Step ST113, the CPU 80 executes key part determination processing that determines (calculates), from the lyric data included in the musical piece data, a repeated portion of the lyrics, sets that this portion is a key part in the basic sound waveform data of the analysis result data corresponding to the repeated portion of the lyrics determined to be a key part, and records this information in the analysis result data.

There are many instances in which the repeated portion of the lyrics also corresponds to the hook, and the volume settings, which will be explained later, and the like are caused to reflect this by setting that this portion is a key part.

Then, once the processing of Step ST113 is completed, processing returns to the processing of the main routine in FIG. 4.

Next, the processing of Step ST13 in FIG. 4, which was mentioned would be explained later, or in other words, the right hand practice processing shown in FIG. 6, will be described.

The right hand practice processing shown in FIG. 6 is processing carried out by the CPU 80, and mainly shows, from among the necessary processing during the right hand practice mode, portions other than auto-play. In reality, when the instrument is about to stop the progression of auto-play, a command causing the sound source unit 50 to carry out the processing thereof is sent, and when the instrument is about to resume the progression of auto-play, a command causing the sound source unit 50 to carry out the processing thereof is sent.

As shown in FIG. 6, the CPU 80 acquires analysis result data and data for the second musical instrument sound (accompaniment data) corresponding to the selected musical piece from the storage unit 70 in Step ST201, and, in Step ST202, begins auto-play of the accompaniment using as a fourth volume (BV) the volume when a sound, based on the second musical instrument sound waveform data corresponding to the second musical instrument sound data of the data for the second musical instrument sound, is generated from the sound generation unit 51.

When the auto-play of the accompaniment begins, the CPU 80 executes the following: sound generation instruction receiving processing that sequentially receives second sound generation instructions corresponding to the pitch specified by the data for the second musical instrument sound; output processing that sequentially outputs to the sound source unit 50 the second musical instrument sound waveform data for generating, in accordance with the second sound generation instructions received via the sound generation instruction receiving processing, a second musical instrument sound from the sound generation unit 51 at a fourth volume smaller than the first volume to be explained later; and processing that moves the auto-play of the accompaniment forward.

Then, in Step ST203, the CPU 80 acquires the initial data for analysis results of the analysis result data, and in Step ST204, the CPU 80 determines whether or not it is the note-ON timing for the first musical instrument sound data in accordance with the initial data for analysis results acquired in Step ST203.

If the Step ST204 determination result is NO, the CPU 80 determines in Step ST205 whether or not it is the note-OFF timing of the first musical instrument sound data. If the Step ST205 determination result is NO, the CPU 80 once again performs the determination of Step ST204.

In other words, until the determination result of either Step ST204 or Step ST205 becomes YES, the CPU 80 repeats the determinations of Step ST204 and Step ST205.

When the Step ST204 determination result is YES, the CPU 80 in Step ST206 turns ON the LEDs 61 for the key 10 that should be pressed, and determines in Step ST207 whether or not the key 10 where the LEDs 61 were turned ON has been pressed.

Here, when the Step ST207 determination result is NO, the CPU 80, in Step ST208, repeats the determination processing of Step ST207 while stopping the progression of the auto-play of the accompaniment while continuing to generate sound based on the current second musical instrument sound waveform data.

Meanwhile, when the Step ST207 determination result is YES, the CPU 80 determines whether or not the progression of auto-play is currently stopped in Step ST209. If this determination result is YES, the CPU 80 resumes the progression of auto-play in Step ST210 and proceeds to Step ST211. If the Step ST210 determination result is NO, the CPU 80 proceeds to Step ST211 without carrying out the processing of Step ST210 since processing for resuming the progression of auto-play is unnecessary.

Next, the CPU 80 sets the first basic volume (MV) of the pressed key 10 (the key 10 corresponding to the first musical instrument sound) based on the key pressing velocity in Step ST211, and, in Step ST212, sets the first volume (MV1) for generation of the sound of the pressed key 10 (the key 10 corresponding to the first musical instrument sound) based on the key pressing velocity (MV1=BV+MV×coefficient).

In this manner, the first volume (MV1) is obtained by using the fourth volume (BV) that is the accompaniment volume and the first basic volume (MV) that is based on the velocity information related to the key pressing velocity and then adding the value of the first basic volume (MV) multiplied by a prescribed coefficient to the fourth volume (BV); thus, as mentioned above, the fourth volume (BV) is smaller than the first volume (MV1).

Next, in Step ST213, the CPU 80 determines whether or not there is lyrical data corresponding to the first musical instrument sound data.

When the Step ST213 determination result is NO, the CPU 80 in Step ST214 executes sound generation instruction receiving processing that receives first sound generation instructions for a musical sound that corresponds to the first pitch of the key 10 (the key 10 corresponding to the first musical instrument sound) specified by being pressed, and sets a note command A (note-ON) for output processing that outputs to the sound source unit 50 the first musical instrument sound waveform data for generating the first musical instrument sound of the first volume (MV1) in accordance with the first sound generation instruction received via the sound generation instruction receiving processing (for output processing that causes the sound generation unit to generate sound according to the first sound generation instruction).

Meanwhile, when the Step ST213 determination result is YES, the CPU 80, in Step ST215, sets a second volume (UV1) for sound generation of the singing voice waveform data generated as the basic sound waveform data of the first pitch in accordance with the first pitch and the basic sound waveform data of the data for analysis results acquired in Step ST203.

Specifically, the second volume (UV1) is obtained by adding the basic volume (UV) of the data for analysis results acquired in Step ST203 to the first volume (MV1) set in Step ST212.

Thus, the second volume (UV1) is larger than the first volume (MV1).

As will be explained later, in a case in which the processing where the next data for analysis results of the present analysis result data is acquired in Step ST230 is carried out, the second volume (UV1) is obtained in Step ST215 by adding the basic volume (UV) of the next data for analysis results acquired in Step ST230 to the first volume (MV1) set in Step ST212. Even in such a case, the second volume (UV1) is larger than the first volume (MV1).

Thus, the sound generation of the singing voice waveform data is always carried out at a volume that is larger than the volume of the first musical instrument sound waveform data generated at the first volume.

In addition, since the second musical instrument sound waveform data of the accompaniment is generated at the fourth volume that is smaller than the first volume, the sound generation of the singing voice waveform data is always carried out at a volume that is larger than the volume of the second musical instrument sound waveform data generated at the fourth volume.

Next, in Step ST216, the CPU 80 determines whether or not key part has been set in the basic sound waveform data of the analysis result data (whether the basic sound waveform data in the analysis result data is a key part).

When the Step ST216 determination result is NO, the CPU 80 in Step ST217 executes sound generation instruction receiving processing that receives first sound generation instructions for a musical sound that corresponds to the first pitch of the key 10 (the key 10 corresponding to the first musical instrument sound) specified by being pressed, and sets a note command A (note-ON) for output processing that, in accordance with the first sound generation instruction received via the sound generation instruction receiving processing, outputs to the sound source unit 50 the first musical instrument sound waveform data for generating the first musical instrument sound of the first volume from the sound generation unit 51 and outputs to the sound source unit 50 the singing voice waveform data for generating the singing voice from the sound generation unit 51 at the second volume (UV1) (for output processing that causes the sound generation unit to generate sound according to the first sound generation instruction).

When the note command A (note-ON) of ST217 is set, processing is carried out in which a third volume (UV2) that is larger than the second volume by a volume $\alpha$ is used in place of the second volume (UV1) for sound generation of the singing voice waveform data when the first pitch of the key 10 (the key 10 corresponding to the first musical instrument sound) specified by being pressed is included in the high tone pitch range by referencing the high tone pitch range greater than or equal to the threshold recorded in the analysis result data in Step ST111 in FIG. 5.

Meanwhile, when the Step ST216 determination result is YES, this means that the basic sound waveform data was determined to be a key part during the key part determination processing of Step ST112 and Step ST113 of FIG. 5; thus, in Step ST218, the CPU 80 sets the third volume (UV2), which is larger than the second volume by the volume $\alpha$, in place of the second volume (UV1) for sound generation of the singing voice waveform data.

In other words, since the singing voice waveform data corresponds to the singing voice of an output part determined to be a key part, in Step ST218, volume setting processing (processing that emphasizes such that sound is generated at a large volume) for outputting singing voice waveform data for generating a singing voice of the third volume (UV2) that is larger than the second volume (UV1) is carried out.

Then, in Step ST219, the CPU 80 executes sound generation instruction receiving processing that receives first sound generation instructions for a musical sound that corresponds to the first pitch of the key 10 (the key 10 corresponding to the first musical instrument sound) specified by being pressed, and sets a note command A (note-ON) for output processing that, in accordance with the first sound generation instructions received via the sound generation instruction receiving processing, outputs to the sound source unit 50 the first musical instrument sound waveform data for generating the first musical instrument sound of the first volume (MV1) from the sound generation unit 51 and outputs to the sound source unit 50 the singing voice waveform data for generating the singing voice from the sound generation unit 51 at the third volume (UV2) (for output processing that causes the sound generation unit to generate sound according to the first sound generation instruction).

As mentioned above, when the processing of any of Step ST214, Step ST217, and Step ST219 is finished, the CPU 80 in Step ST220 executes output processing (sound source unit processing) by outputting the note command A (note-ON) to the sound source unit 50, and as will be explained later with reference to FIG. 7, causes the sound source unit 50 to carry out processing in accordance with the note-ON command.

Next, in Step ST221, the CPU 80 determines whether or not note-OFF relating to the current first musical instrument sound that was set to note-ON has been completed. If this determination result is NO, the CPU 80 returns to Step ST204.

As a result, in a case in which note-OFF relating to the current first musical instrument sound that was set to note-ON has not been completed, the CPU 80 repeats the determination processing of Step ST205, and waits for the note-OFF timing of the first musical instrument sound data.

Then, when the Step ST205 determination result becomes YES, the CPU 80 in Step ST222 turns OFF the LEDs 61 for the key 10 that should be released, and determines in Step ST223 whether or not the key 10 where the LEDs 61 were turned OFF has been released.

Here, when the Step ST223 determination result is NO, the CPU 80, in Step ST224, repeats the determination processing of Step ST223 while stopping the progression of the auto-play of the accompaniment and continuing to generate sound based on the current second musical instrument sound waveform data.

Meanwhile, when the Step ST223 determination result is YES, the CPU 80 determines whether or not the progression of auto-play is currently stopped in Step ST225. If this determination result is YES, the CPU 80 resumes the progression of auto-play in Step ST226 and proceeds to Step ST227.

Conversely, if the Step ST223 determination result is NO, the CPU 80 proceeds to Step ST227 without carrying out the processing of Step ST226 since processing for resuming the progression of auto-play is unnecessary.

Next, the CPU 80 sets the note command A (note-OFF) for the released key 10 (the key 10 corresponding to the first musical instrument sound) in Step ST227, and in Step ST228, outputs the note command A (note-OFF) to the sound source unit 50 and causes the sound source unit 50 to carry out processing in accordance with the note-OFF command, as will be explained later with reference to FIG. 7.

Thereafter, in Step ST221, the CPU 80 determines whether or not note-OFF relating to the current first musical instrument sound that was set to note-ON has been completed. If this determination result is YES, the CPU 80 determines in Step ST229 whether or not any next data for analysis results is left in the analysis result data.

Then, if the Step ST229 determination result is YES, the CPU 80, in Step ST230, acquires the next data for analysis results and then returns to Step ST204, and then repeats the processing of Step ST204 to Step ST229. Meanwhile, if the Step ST229 determination result is NO, the CPU 80 returns to the main routine shown in FIG. 4, and all processing ends.

Next, the contents of sound source unit processing implemented after proceeding to Step ST220 or Step ST228 will be described while referencing FIG. 7.

The sound source unit processing is processing carried out in which a DSP of the sound source unit 50 (hereinafter referred to simply as "DSP") functions as the sound control unit, the processing being executed in accordance with the transmission of commands from the CPU 80 to the sound source unit 50.

As shown in FIG. 7, in Step ST301, the DSP repeatedly determines whether or not a command has been received from the CPU 80.

When the Step ST301 determination result is YES, the DSP determines in Step ST302 whether or not the received command is the note command A. If this determination result is NO, the DSP carries out processing other than note command A processing, such as accompaniment part processing (processing related to auto-play of the accompaniment) or the like in Step ST303.

Meanwhile, when the Step ST302 determination result is YES, the DSP determines in Step ST304 whether or not the received note command A is a note-ON command.

When the Step ST304 determination result is YES, the DSP determines in Step ST305 whether or not there is singing voice waveform data in the note command A (note-ON command).

Then, if the Step ST305 determination result is NO, the DSP executes in Step ST306 processing that generates the first musical instrument sound, or in other words, processing that causes the sound generation unit 51 to generate sound for the first musical instrument sound waveform data at the first volume (MV1).

In addition, if the Step ST305 determination result is YES, the DSP executes in Step ST307 processing that generates the first musical instrument sound and the singing voice, or in other words, processing that causes the sound generation unit 51 to generate sound for the first musical instrument sound waveform data at the first volume (MV1) and causes the sound generation unit 51 to generate sound for the singing voice waveform data at the second volume (UV1) or the third volume (UV2).

Whether the singing voice waveform data will be generated at the second volume (UV1) or the third volume (UV2) is determined by which of the second volume (UV1) and the third volume (UV2) has been set during the previously-described setting of the note command A (note-ON command).

Meanwhile, when the Step ST304 determination result is NO, or in other words, when the received command is the note-OFF command, the DSP executes in Step ST308 processing that mutes the singing voice and the first musical instrument sound being generated from the sound generation unit 51.

As described above, according to Embodiment 1, the volume of the singing voice generated in the practice modes is always generated from the sound generation unit 51 at a volume larger than the volume of the melody and the accompaniment; thus, the singing voice is easy to hear.

Moreover, the portion corresponding to the hook and the like of the lyrics is set at an even larger volume; thus, a powerful singing voice is generated from the sound generation unit 51.

In the above-mentioned embodiment, processing proceeds only when, according to the determination of Step ST207 of FIG. 6, that a key 10 in accordance with a guide has been pressed; thus, the first pitch of the key 10 (the key 10 corresponding to the first musical instrument sound) specified via the pressing becomes the pitch of the note included in the musical piece data.

However the musical instrument may be configured to include a case in which the Step ST207 determination is not provided and the pitch of the key 10 (the key 10 corresponding to the first musical instrument sound) specified via pressing is the second pitch that is not the pitch of the note of the melody part included in the musical piece data.

In such a case, the musical instrument may be configured such that the performer can set the musical instrument to: a first mode in which the first pitch of the specified key 10 (the key 10 corresponding to the first musical instrument sound) described above is a pitch of a note included in the musical piece data; and a second mode that includes a case in which the pitch of the specified key 10 is the second pitch which is not a pitch of a note of the melody part included in the musical piece data.

In addition, the musical instrument may be configured to perform mode selection processing in which the CPU 80 chooses between the first mode and the second mode in accordance with which of the first mode and the second mode that the performer set the musical instrument to, and then either the first mode or the second mode is implemented.

Furthermore, when the second mode is selected, if the pitch of the key 10 (the key 10 corresponding to the first musical instrument sound) specified via pressing is the second pitch that is not the pitch of a note included in the musical piece data, the basic sound waveform data generated in accordance with the second pitch may be used as the singing voice waveform data.

Furthermore, during the second mode, the guiding of the pressing and releasing of the keys via turning the LEDs 61 ON and OFF may be omitted.

Modification Example of Embodiment 1

Next, a modification example of Embodiment 1 of the present invention will be described with reference to FIG. 8.

Figure 8:
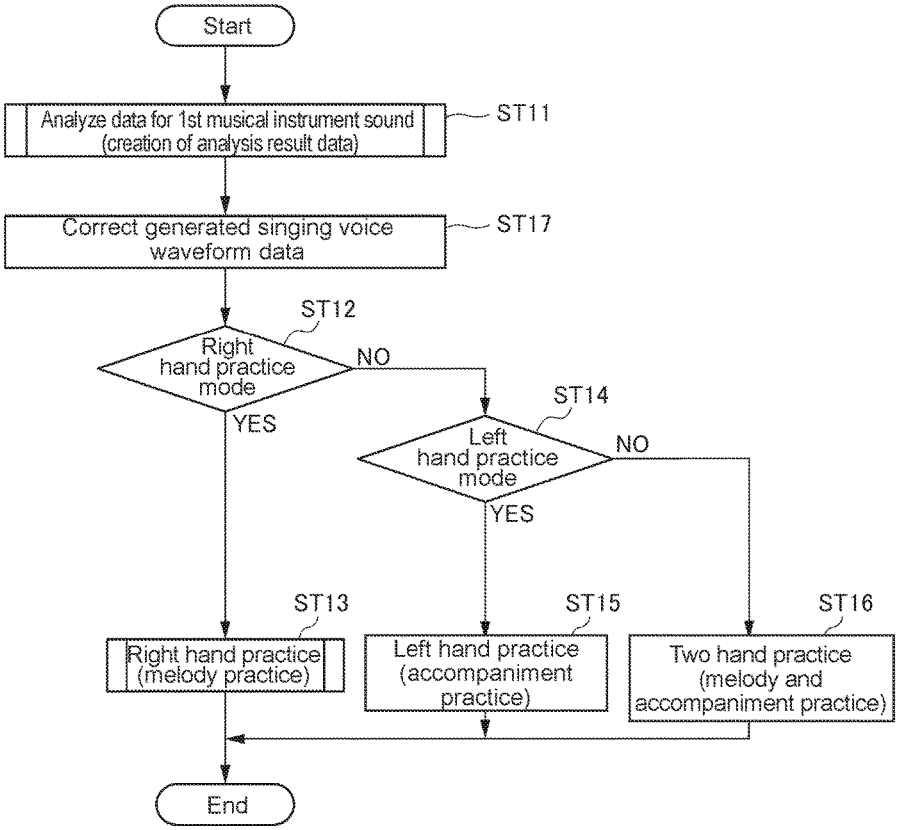
FIG. 8 is a flow chart showing a modification example of the practice mode executed by the CPU according to Embodiment 1 of the present invention.

FIG. 8 is a flow chart showing the modification example of Embodiment 1.

The basic contents of the electronic musical instrument 1 of the present embodiment are the same as already described in Embodiment 1. Accordingly, only components that differ from Embodiment 1 will be described below for the most part, and a description may be omitted for points identical to Embodiment 1.

As shown in FIG. 8, the main routine that the CPU 80 carries out in the modification example of Embodiment 1 differs from the main routine of Embodiment 1 shown in FIG. 4 by including the processing of Step ST17.

In Step ST17, the CPU 80 corrects the singing voice waveform data generated in accordance with the first pitch or the second pitch.

Specifically, the musical instrument is configured so as to include a filter processing unit that filter-processes a certain frequency band included in the basic sound waveform data generated in accordance with the first pitch or the second pitch, and is configured such that the singing voice waveform data is generated by filter-processing the certain frequency band included in the basic sound waveform data generated in accordance with the first pitch or the second pitch using this filter processing unit.

For example, possible examples of filter processing are: processing that amplifies the amplitude of certain frequency bands that are buried within the first musical instrument sound (melody sound) and second musical instrument sound (accompaniment sound) and may be hard to hear, thereby making these frequency bands easier to hear; processing that amplifies the amplitude of a treble portion of a frequency included in the basic sound waveform data, sharpens the sound pathway characteristics, and emphasizes individuality; or the like.

Embodiment 2

Next, Embodiment 2 of the present invention will be described with reference to FIGS. 9 to 12.

Figure 9:
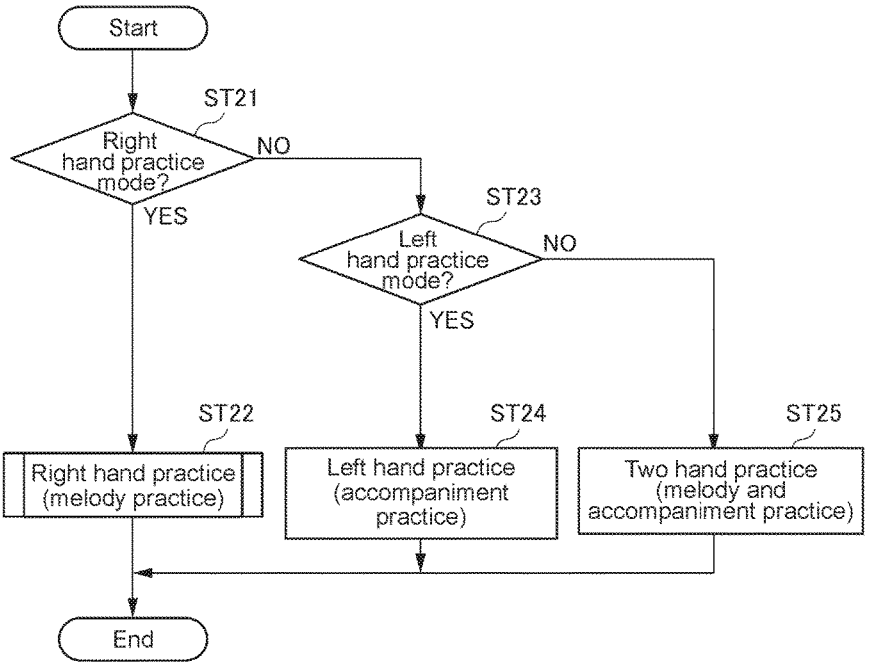
FIG. 9 is a flow chart showing a main routine of a practice mode executed by the CPU according to Embodiment 2 of the present invention.
Figure 10:
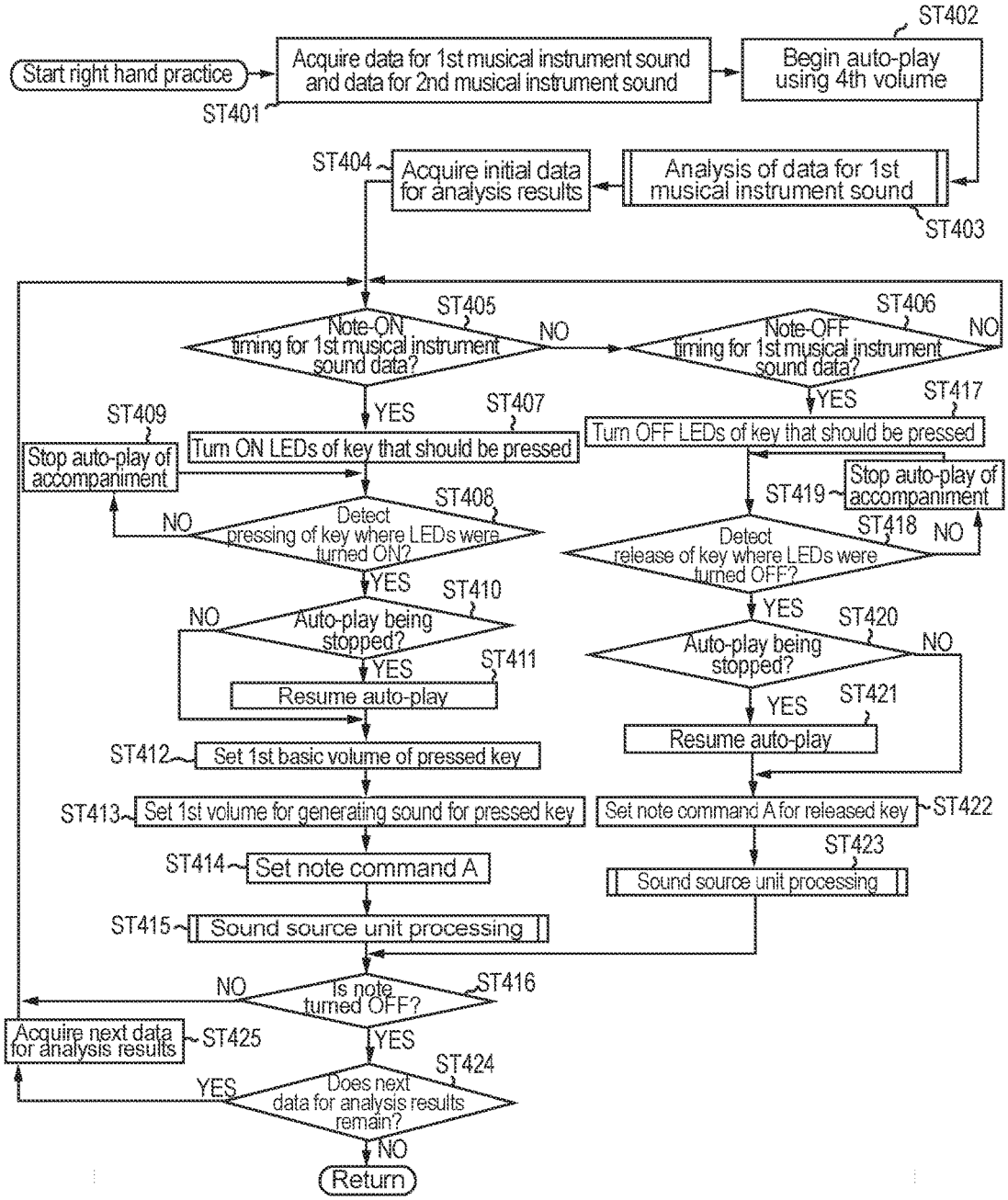
FIG. 10 is a flow chart of right hand practice, which is a subroutine of a right hand practice mode executed by the CPU according to Embodiment 2 of the present invention.
Figure 11:
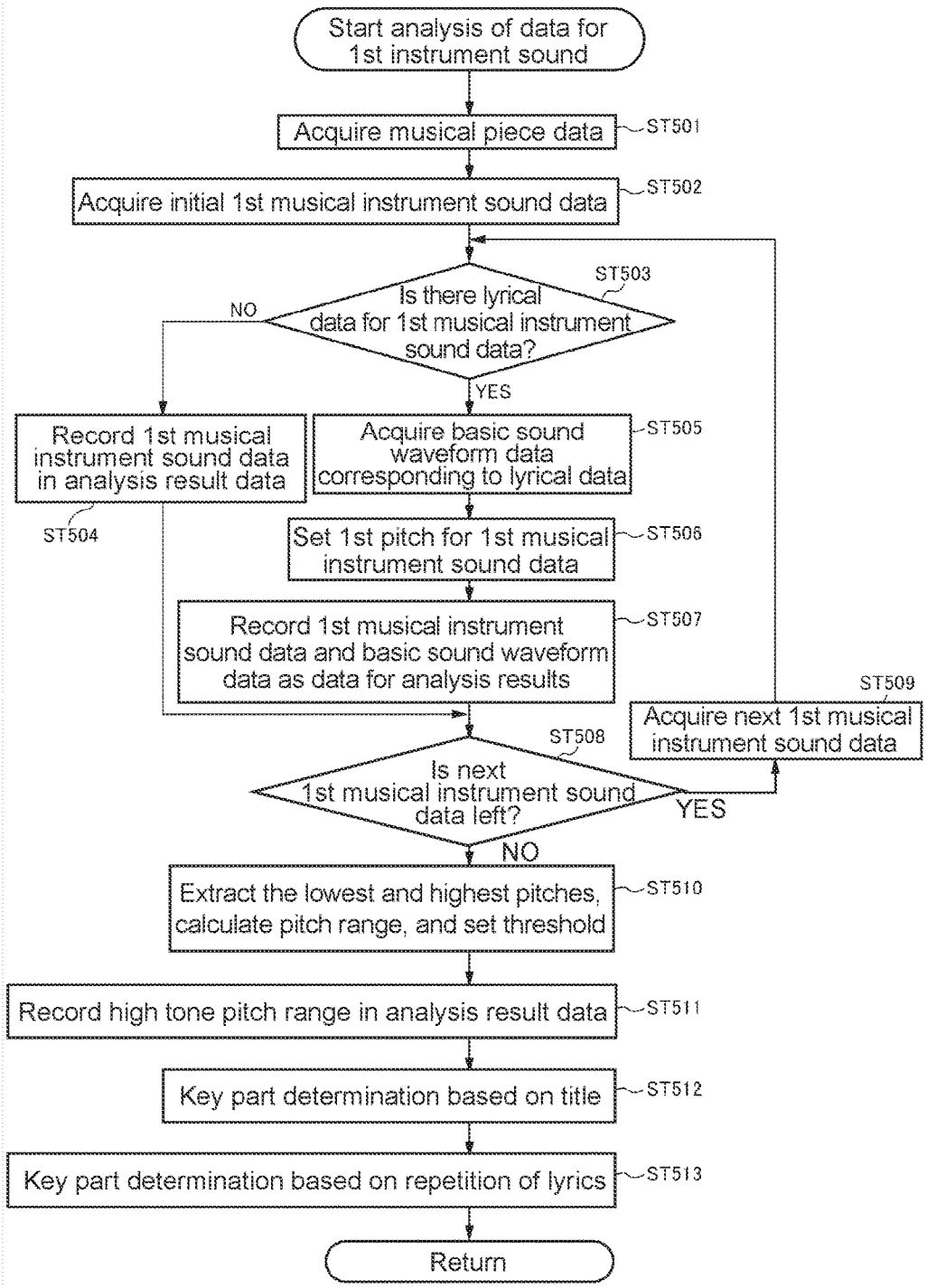
FIG. 11 is a flow chart of data analysis for the first musical instrument sound, which is a subroutine of the right hand practice mode executed by the CPU according to Embodiment 2 of the present invention.
Figure 12:
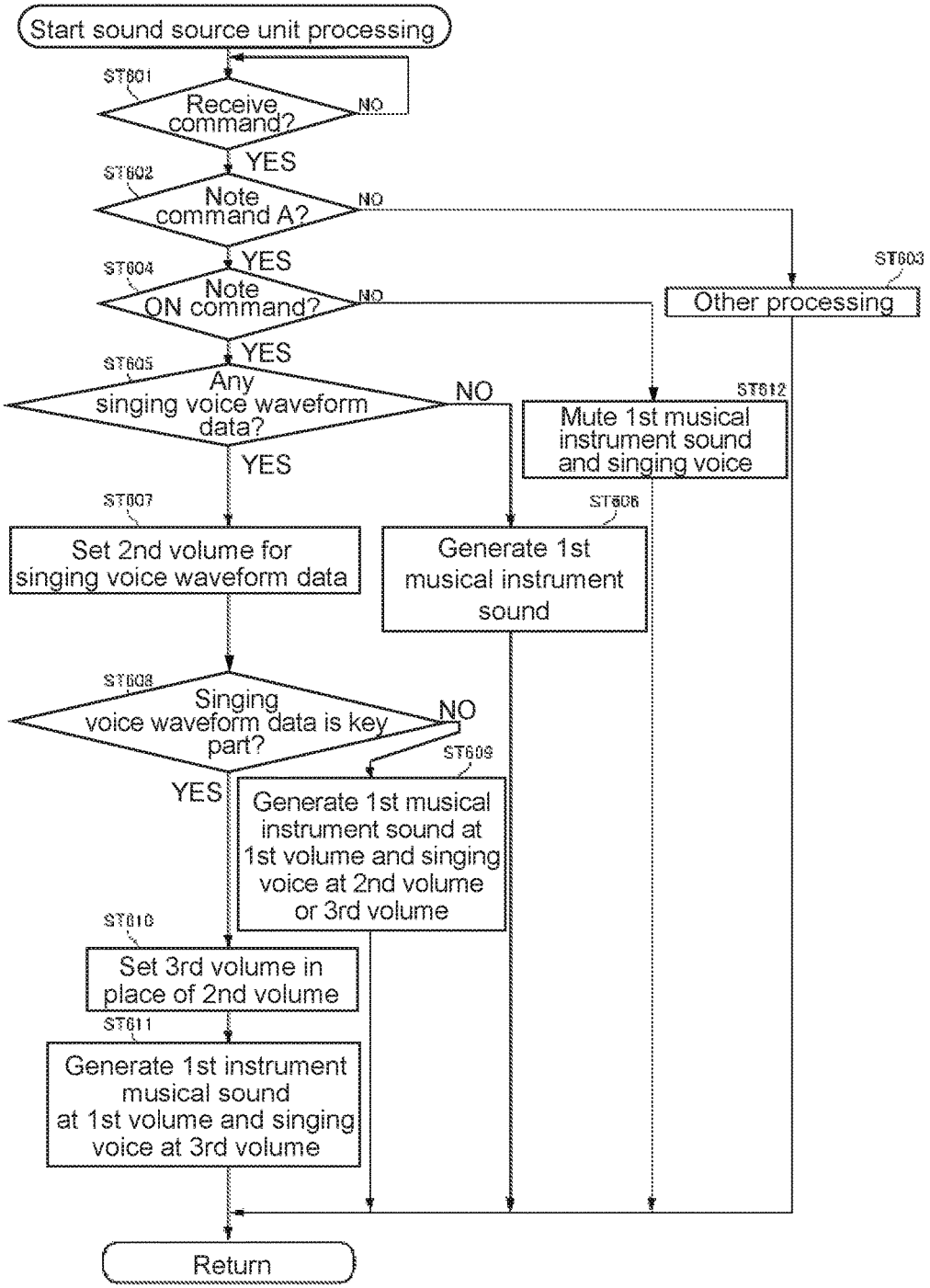
FIG. 12 is a flow chart of sound source unit processing executed by the sound source unit according to Embodiment 2 of the present invention.

FIG. 9 is a flow chart showing a main routine of the practice modes executed by the CPU 80, FIG. 10 is a flow chart of right hand practice, which is a subroutine of the right hand practice mode executed by the CPU 80, FIG. 11 is a flow chart of data analysis for the first musical instrument sound, which is a subroutine of the right hand practice mode executed by the CPU 80, and FIG. 12 is a flow chart of sound source unit processing executed by the sound source unit 50 (DSP).

The basic contents of the electronic musical instrument 1 of the present embodiment are the same as already described in Embodiment 1. Accordingly, only components that differ from Embodiment 1 will be described below for the most part, and a description may be omitted for points identical to Embodiment 1.

Embodiment 2 shown in FIGS. 9 to 12 mainly differs from Embodiment 1 in that: the data analysis processing for the first musical instrument sound is carried out not in the main routine but in right hand practice processing; and the setting of the volume for generating sound for the singing voice waveform data is performed in the sound source unit processing.

Once a performer conducts a prescribed starting operation after having selected a practice mode and musical piece by operating the operation panel 31 or the like, the CPU 80 begins the main flow processing shown in FIG. 9.

As shown in FIG. 9, the CPU 80, in Step ST21, determines whether or not the practice mode selected by the performer is the right hand practice mode.

When the Step ST21 determination result is YES, the CPU 80 proceeds to the right hand practice processing (Step ST22), which will be explained later, and when the determination result is NO, the CPU 80 proceeds to determining whether or not the selected practice mode is the left hand practice mode (Step ST23).

When the Step ST23 determination result is YES, the CPU 80 begins left hand practice processing (Step ST24).

Then, in the left hand practice processing, the musical instrument guides the performer to press keys by turning ON the LEDs 61 when the keys 10 that should be pressed should be pressed for the accompaniment part performed using the left hand, guides the performer to release the keys by turning OFF the LEDs 61 when the pressed keys 10 are to be released, auto-plays the melody part performed using the right hand, and outputs the singing voice so as to match the melody.

The volumes of the melody, accompaniment, and singing voice during left hand practice are generated from the sound generation unit 51 using the same volume relationship as for the right hand practice, which will be explained later.

When the Step ST23 determination result is NO, the CPU 80 executes the two hand practice mode that is the remaining practice mode.

Specifically, when the Step ST23 determination result is NO, the CPU 80 begins two hand practice processing (Step ST25).

In the two hand practice processing, the musical instrument 1 guides the performer to press keys by turning ON the LEDs 61 when the keys 10 that should be pressed should be pressed for the melody part performed using the right hand and the accompaniment part performed using the left hand, guides the performer to release the keys by turning OFF the LEDs 61 when the pressed keys 10 are to be released, and additionally outputs the singing voice so as to match the melody.

The volumes of the melody, accompaniment, and singing voice during two hand practice are generated from the sound generation unit 51 using the same volume relationship as for the right hand practice, which will be explained later.

Furthermore, in a case in which processing has proceeded to the above-mentioned Step ST22, the right hand practice processing shown in FIG. 10 is executed by the CPU 80.

Specifically, as shown in FIG. 10, the CPU 80 acquires the data for the second musical instrument sound (accompaniment data) and the data for the first musical instrument sound (melody data) corresponding to the musical piece selected from the storage unit 70 in Step ST401, and, in Step ST402, begins auto-play of the accompaniment using as a fourth volume (BV) the volume when a sound, based on the second musical instrument sound waveform data corresponding to the second musical instrument sound data of the data for the second musical instrument sound, is generated from the sound generation unit 51.

As in Embodiment 1, when auto-play of the accompaniment begins, the CPU 80 executes the following: sound generation instruction receiving processing that sequentially receives second sound generation instructions corresponding to the pitch specified by the data for the second musical instrument sound; output processing that sequentially outputs to the sound source unit 50 the second musical instrument sound waveform data for generating, in accordance with the second sound generation instructions received via the sound generation instruction receiving processing, a second musical instrument sound from the sound generation unit 51 at a fourth volume smaller than the first volume; and processing that moves the auto-play of the accompaniment forward.

Then, the CPU 80 executes, in Step ST403, analysis processing (creation of analysis result data) of data (melody data) for the first musical instrument sound, which will be explained later, and thereafter acquires the initial data for analysis results of the analysis result data in Step ST404.

Next, the CPU 80 determines whether or not it is the note-ON timing of the first musical instrument sound data in Step ST405, and determines whether or not it is the note-OFF timing for the first musical instrument sound data in Step ST406. The CPU 80 repeats the determinations of Step ST405 and Step ST406 until either determination result becomes YES.

This processing is identical to Step ST204 and Step ST205 in FIG. 6 of Embodiment 1.

Then, when the Step ST405 determination result is YES, the CPU 80 in Step ST407 turns ON the LEDs 61 for the key 10 that should be pressed, and determines in Step ST408 whether or not the key 10 where the LEDs 61 were turned ON has been pressed.

Here, similar to Step ST208 and Step ST209 in FIG. 6 of Embodiment 1, when the Step ST408 determination result is NO, the CPU 80, in Step ST409, repeats the determination processing of Step ST408 while stopping the progression of the auto-play of the accompaniment while continuing to generate sound based on the current second musical instrument sound waveform data.

Meanwhile, when the Step ST408 determination result is YES, the CPU 80 determines whether or not the progression of auto-play is currently stopped in Step ST410. If this determination result is YES, the CPU 80 resumes the progression of auto-play in Step ST411 and proceeds to Step ST412. If the determination result is NO, the CPU 80 proceeds to Step ST412 without carrying out the processing of Step ST411 since processing for resuming the progression of auto-play is unnecessary.

Next, similar to Step ST211 and Step ST212 in FIG. 6 of Embodiment 1, the CPU 80 sets the first basic volume (MV) of the sound (the first musical instrument sound) of the pressed key 10 (the key 10 corresponding to the first musical instrument sound) based on the key pressing velocity in Step ST412, and sets the first volume (MV1) for generating the sound of the pressed key 10 (the key 10 corresponding to the first musical instrument sound) in Step ST413 (MV1=BV+MV×coefficient).

Then, the CPU 80 in Step ST414 executes sound generation instruction receiving processing that receives first sound generation instructions for a musical sound that corresponds to the first pitch of the key 10 (the key 10 corresponding to the first musical instrument sound) specified by being pressed, and sets the note command A (note-ON) for output processing that outputs to the sound source unit 50 the first musical instrument sound waveform data for generating the first musical instrument sound of the first volume (MV1) in accordance with the first sound generation instruction received via the sound generation instruction receiving processing (for output processing that causes the sound generation unit to generate sound according to the first sound generation instruction).

When basic sound waveform data is included in the data for analysis results, the singing voice waveform data generated as the basic sound waveform data of the first pitch is set when the note command A (note-ON) is set.

In, addition, in the data analysis processing for the first musical instrument sound (FIG. 11) to be explained later, when a key part is set with respect to the basic sound waveform data of the analysis result data, the key part is set with respect to the singing voice waveform data generated as the basic sound waveform data of the first pitch when the note command A (note-ON) is set.

Furthermore, when this note command A (note-ON) is set, in a case in which the singing voice waveform data generated as the basic sound waveform data of the first pitch is included in a high tone pitch range greater than or equal to the threshold of the analysis result data, the singing voice waveform data is set as a high tone greater than or equal to the threshold.

When the setting of the note command A (note-ON) is finished, the CPU 80 in Step ST415 executes output processing by outputting the note command A (note-ON) to the sound source unit 50, and as will be explained later with reference to FIG. 12, causes the sound source unit 50 to carry out processing in accordance with the note-ON command.

In addition, in Step ST416, the CPU 80 determines whether or not note-OFF relating to the current first musical instrument sound that was set to note-ON has been completed. If this determination result is NO, the CPU 80 returns to Step ST405.

As a result, similar to Embodiment 1, in a case in which note-OFF relating to the current first musical instrument sound that was set to note-ON has not finished, the CPU 80 repeats the determination processing of Step ST406, and waits for the note-OFF timing of the first musical instrument sound data.

In addition, when the Step ST406 determination result is YES, the CPU 80 executes the processing of Step ST417 to Step ST423, which is the same processing as Step ST222 to Step ST228 in FIG. 6 of Embodiment 1, and once again determines in Step ST416 whether or not note-OFF relating to the current first musical instrument sound that was set to note-ON has finished.

If this determination result is YES, the CPU 80 determines in Step ST424 whether or not there is any next data for analysis results remaining in the analysis result data.

Then, when the Step ST424 determination result is YES, the CPU 80 returns to Step ST405 after acquiring the next data for analysis results in Step ST425, and then repeats the processing of Step ST405 to Step ST424. Meanwhile, if the Step ST424 determination result is NO, the CPU 80 returns to the main routine in FIG. 9, and all processing ends.

Here, it can be seen when comparing Step ST412 to Step ST415 in the flow chart in FIG. 10 and Step ST215 to Step ST220 in the flow chart in FIG. 6, that while the overall processing is similar, the setting of the volume (the second volume or the third volume) when sound is generated for the singing voice waveform data is not carried out in the flow chart in FIG. 10, and this portion is carried out in the sound source unit processing, which will be mentioned later with reference to FIG. 12.

Next, before explaining the flow in FIG. 12, the data analysis processing for the first musical instrument sound shown in FIG. 11 will be described.

This processing is processing that is similar to the processing carried out in Step ST11 in FIG. 4 of Embodiment 1. However, Embodiment 2 differs in that this processing is carried out as the processing of Step ST403 of FIG. 10.

The data analysis processing for the first musical instrument sound is processing that is carried out by the CPU 80 as with Embodiment 1. The data analysis processing for the first musical instrument sound is processing that obtains data for analysis results corresponding to the respective first musical instrument sound data included in the data for the first musical instrument sound, and creates analysis result data that is an aggregate of the respective obtained data for analysis results.

As shown in FIG. 11, the CPU 80, in Step ST501, acquires musical piece data corresponding to the selected musical piece from the storage unit 70, and in Step ST502, acquires the initial first musical instrument sound data from the data for the first musical instrument sound within the musical piece data.

Then, after acquiring the first musical instrument sound data, the CPU 80 in Step ST503 determines whether or not there is lyrical data corresponding to the first musical instrument sound data from the lyric data in the musical piece data. If the Step ST503 determination result is NO, the CPU 80, in Step ST504, records the first musical instrument sound data as data for analysis results that will be one piece of data in the data series of the analysis result data in the storage unit 70.

If the Step ST503 determination result is YES, the CPU 80, in Step ST505, acquires basic sound waveform data corresponding to the lyrical data from the data for lyrical sound in the storage unit 70.

Then, in Step ST506, the CPU 80 sets the first pitch of the first musical instrument sound data to the pitch of the acquired basic sound waveform data.

While the basic volume (UV) with respect to the basic sound waveform data was set in Step ST106 in FIG. 5 of Embodiment 1, which corresponds to Step ST506, in Embodiment 2, the volume setting is carried out during the sound source unit processing shown in FIG. 12; thus, the basic volume (UV) is not set in Step ST506.

Next, in Step ST507, the CPU 80 records the first musical instrument sound data and the basis sound waveform data in which the first pitch has been set so as to correspond to the first musical instrument sound data as data for analysis results that will be one piece of data in a data series of the analysis result data in the storage unit 70.

Once the processing of Step ST504 or Step ST507 has been completed, the CPU 80 determines in Step ST508 whether or not there is next first musical instrument sound data left in the data for the first musical instrument sound.

Then, when the Step ST508 determination result is YES, the CPU 80, in Step ST509, acquires the next first musical instrument sound data from the data for the first musical instrument sound, and thereafter returns to Step ST503 and repeats the processing of Step ST504 or Step ST505 to Step ST507.

When the Step ST508 determination result is NO, similar to Step ST110 and Step ST111 in FIG. 5 of Embodiment 1, the CPU 80 in Step ST510 extracts the lowest pitch and the highest pitch among the first pitches from a plurality of note pitches included in the data for the first musical instrument sound included in the musical piece data, calculates a pitch range, sets a threshold based on the pitch range, and then records the high tone pitch range greater than or equal to the threshold in the analysis result data in Step ST511.

For example, the threshold value may in such as case, similar to Embodiment 1, be set to 90% or higher of the pitch range, or the like.

In addition, similar to Step ST112 in FIG. 5 of Embodiment 1, the CPU 80 in Step ST512 acquires the lyric title name data from the lyric data included in the musical piece data, compares the title name and the arrangement of second lyric sound data of the created analysis result data, executes key part determination processing that determines (calculates) a range that matches the title name, sets that this range is a key part in the basic sound waveform data of the analysis result data corresponding to the range that matches the title name of the lyrics determined to be a key part, and records this information in the analysis result data.

Furthermore, similar to Step ST113 in FIG. 5 of Embodiment 1, the CPU 80 in Step ST513 executes key part determination processing that determines (calculates) a repeated portion of the lyrics from the lyric data included in the musical piece data, sets that this portion is a key part in the basic sound waveform data of the analysis result data corresponding to the repeated portion of the lyrics determined to be a key part, records this information in the analysis result data, and thereafter returns to the processing in FIG. 10.

As mentioned above, the data analysis processing for the first musical instrument sound shown in FIG. 11 is processing substantially similar to the data analysis processing for the first musical instrument sound shown in FIG. 5, but differs in that the basic volume (UV) for the basic sound waveform data is not set in Step ST506.

Next, the sound source unit processing shown in FIG. 12 will be described.

The sound source unit processing shown in FIG. 12 is processing carried out in which the DSP of the sound source unit 50 (hereafter referred to simply as "DSP") functions as a sound control unit, and which is executed in accordance with the transmission of commands from the CPU 80 to the sound source unit 50.

As can be seen by comparing FIG. 12 and FIG. 7, Step ST601 to Step ST604 and Step ST612 shown in FIG. 12 are the same processing as Step ST301 to Step ST304 and Step ST308 shown in FIG. 7; thus a description thereof is omitted, and Step ST605 to Step ST611 will be described below.

When the Step ST604 determination result is YES, the DSP determines in Step ST605 whether or not the note command A (note-ON) has singing voice waveform data.

Then, when the Step ST605 determination result is NO, the DSP executes in Step ST606 processing that generates the first musical instrument sound.

Specifically, the DSP, in accordance with the first volume (MV1) and the first musical instrument sound waveform data included in the note command A (note-ON), executes processing that causes the sound generation unit 51 to generate sound for the first musical instrument sound waveform data at the first volume (MV1).

Meanwhile, when the Step ST605 determination result is YES, the DSP executes processing that sets the second volume (UV1) for generating sound for the singing voice waveform data (ST607).

Specifically, similar to the second volume (UV1) for Embodiment 1, the processing sets the second volume (UV1), in which the first volume (MV1) has been added to the basic volume (UV), for the basic sound waveform data that is the source of the singing voice waveform data.

Then, the DSP determines in Step ST608 whether or not the singing voice waveform data included in the note command A (note-ON) is a key part.

When this determination result is NO, the DSP executes in Step ST609 processing that generates a first musical instrument sound of the first volume (MV1) and a singing voice of the second volume (UV1) or the third volume (UV2).

Specifically, when a high tone that is greater than or equal to a threshold has not been set in the singing voice waveform data, the DSP executes processing that causes the sound generation unit 51 to generate sound for the first musical instrument sound waveform data at the first volume (MV1) and that causes the sound generation unit 51 to generate sound for the singing voice waveform data at the second volume (UV1).

Conversely, when a high tone greater than or equal to a threshold has been set in the singing voice waveform data, the DSP executes processing that causes the sound generation unit 51 to generate sound for the first musical instrument sound waveform data at the first volume (MV1) and that causes the sound generation unit 51 to generate sound for the singing voice waveform data at the third volume (UV2) that is larger than the second volume by the volume $\alpha$.

Meanwhile, when the Step ST608 determination result is YES, the DSP in Step ST610 executes processing that sets the third volume (UV2), which is larger than the second volume by the volume $\alpha$, in place of the second volume (UV1) for sound generation for the singing voice waveform data.

Then, in Step ST611, the DSP executes processing that generates a first musical instrument sound of the first volume (MV1) and a singing voice of the third volume (UV2).

In other words, the DSP executes processing that causes the sound generation unit 51 to generate sound for the first musical instrument sound waveform data at the first volume (MV1) and that causes the sound generation unit 51 to generate sound for the singing voice waveform data at the third volume (UV2) that is larger than the second volume by the volume α.

As described above, in Embodiment 2, the DSP, which functions as the sound control unit (also referred to as simply a control unit) of the sound source unit 50, carries out a portion (volume setting of the singing voice waveform data, or the like, for example) of the processing carried out by the CPU 80 in Embodiment 1. Even in such a configuration, as in Embodiment 1, it is possible to configure the musical instrument such that the volume of the singing voice output during a practice mode is always generated from the sound generation unit 51 at a volume larger than the volume of the melody and accompaniment, making it possible for the singing voice to be easier to hear.

Moreover, the musical instrument can be configured such that the volume of the portion corresponding to the hook and the like of the lyrics is set at an even larger volume; thus, a powerful singing voice can be generated from the sound generation unit 51.

The electronic musical instrument 1 of the present invention was described above in accordance with specific embodiments; however, the present invention is not limited to the above-described specific embodiments.

For example, in the above-described embodiments, a case was illustrated in which the musical instrument 1 included the CPU 80 that carries out overall control and the DSP that controls the sound source unit 50, and in which the DSP was caused to carry out the function of a sound control unit that causes the sound generation unit 51 to generate sound. However, it is not absolutely necessary that the musical instrument be configured in this manner.

For example, the musical instrument may be configured such that the DSP of the sound source unit 50 is omitted and the CPU 80 also handles the control of the sound source unit 50, and conversely, the musical instrument may be configured such that the DSP of the sound source unit 50 also handles the overall control and the CPU 80 is omitted.

In the present examples, as a result of a pitch being specified by a performer, the CPU 80 executes lyric existence determination processing. When lyric data exists (YES for ST213, FIG. 6, for example), a singing voice sound and a first musical instrument sound corresponding to the specified pitch are output. When no lyric data exists (NO for ST213, FIG. 6, for example), the singing voice sound is not output and only the first musical instrument sound is output.

However, when there is lyric data (YES for ST213, FIG. 6, for example), it is goes without saying that the musical instrument may be configured to not output the first musical instrument sound and only output the lyrical sound.

In addition, the present invention can be applied to a case in which the performer plays using both hands, such as a case in which the right hand plays the melody part and the left hand plays the accompaniment part. In other words, the CPU 80 executes part determination processing that determines whether the specified pitch is either of the melody part or the accompaniment part. As a result, the respective volumes of the melody part and the accompaniment part are set such that the volume based on the melody part is a volume larger than the volume based on the accompaniment part.

In this manner, the present invention is not limited to the specific embodiments, and various modifications, improvements, and the like within a scope in which the aims of the present invention can be achieved are included within the technical scope of the present invention, and this will be clear to a person skilled in the art from the description in the claims.

Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument, comprising:

a plurality of keys, each of the plurality of keys specifying a pitch;

a memory storing musical piece data representing a musical piece; and a processor, wherein said processor executes the following:

receiving a signal indicating an operation of a key, among the plurality of keys, by a user in a timing corresponding to a note in the musical piece;

retrieving the musical piece data of the musical piece from the memory and determining whether the musical piece data contains data of a lyric;

when the musical piece data does not contain the data of the lyric, causing data of a musical instrument sound having a pitch specified by said operated key to be generated in response to the operation of the key, and causing the musical instrument sound to be audibly output; and when the musical piece data contains the data of the lyric, and if said note in the musical piece is accompanied by a part of the lyric, causing data of a singing voice sound having the pitch specified by said operated key to be generated in accordance with the part of the lyric in response to the operation of the key, and causing the singing voice sound to be audibly output.

2. The electronic musical instrument according to claim 1, wherein when the musical piece data contains the data of the lyric, and if said note in the musical piece is accompanied by the part of the lyric, the processor further causes data of the musical instrument sound having the pitch specified by said operated key to be generated and causes the musical instrument sound as well as the singing voice sound to be audibly output.

3. The electronic musical instrument according to claim 1, wherein the musical piece data contains data of an accompaniment that accompanies sound generated by operations of the keys by the user, and wherein said processor further causes the accompaniment to be played along with the musical instrument sound or the singing voice sound at a volume smaller than a volume of the musical instrument sound or the singing voice sound.

4. The electronic musical instrument according to claim 3, wherein the processor further determines whether the note specified by the operated key corresponds to a note of a melody part of the musical piece data, and only when the note specified by the operated key corresponds to the note of the melody part, the processor causes the accompaniment and the musical instrument sound or the singing voice sound to be audibly output.

5. The electronic musical instrument according to claim 1, wherein the plurality of keys are a keyboard having a plurality of white keys and a plurality of black keys, wherein the processor receives from the operated key a velocity value indicating a volume of a sound to be generated by the operation of the key, and wherein in generating the data of the musical instrument sound in response to the operation of the key, the processor causes a volume of the musical instrument sound to be set to the volume indicated by the velocity value, and wherein in generating the data of the singing voice sound in response to the operation of the key, the processor causes a volume of the singing voice sound to be set larger than the volume indicated by the velocity value.

6. The electronic musical instrument according to claim 1, wherein in generating the data of the singing voice sound in response to the operation of the key, the processor causes a basic voice sound waveform to be modified such that prescribed frequency components are amplified and the resulting singing voice sound has the pitch specified by said operated key with the amplified prescribed frequency components.

7. The electronic musical instrument according to claim 5, wherein when the musical piece contains the lyric, and if said note in the musical piece is accompanied by the part of the lyric, the processor further determines whether the part of the lyric is a key part of the lyric or a non-key part of the lyric, and wherein the processor causes the data of the singing voice sound to be generated such that a volume of the singing voice sound generated for the key part of the lyric is larger than a volume of the singing voice sound generated for the non-key part of the lyric.

8. The electronic musical instrument according to claim 7, wherein in determining whether the part of the lyric is the key part of the lyric or the non-key part of the lyric, the processor evaluates whether the part of the lyric contains at least one of a lyric title, a repeated part of the lyric, and a high tone part of the musical piece.

9. A method performed by a processor in an electronic musical instrument that includes: said processor; a plurality of keys, each of the plurality of keys specifying a pitch; and a memory storing musical piece data representing a musical piece, the method comprising:

receiving a signal indicating an operation of a key, among the plurality of keys, by a user in a timing corresponding to a note in the musical piece;

retrieving the musical piece data of the musical piece from the memory and determining whether the musical piece data contains data of a lyric;

when the musical piece data does not contain the data of the lyric, causing data of a musical instrument sound having a pitch specified by said operated key to be generated in response to the operation of the key, and causing the musical instrument sound to be audibly output; and when the musical piece data contains the data of the lyric, and if said note in the musical piece is accompanied by a part of the lyric, causing data of a singing voice sound having the pitch specified by said operated key to be generated in accordance with the part of the lyric in response to the operation of the key, and causing the singing voice sound to be audibly output.

10. A non-transitory computer-readable storage medium having stored thereon a program executable by a processor in an electronic musical instrument, the electronic musical instrument including: said processor, a plurality of keys, each of the plurality of keys specifying a pitch; and a memory storing musical piece data representing a musical piece, the program causing the processor to perform the following:

receiving a signal indicating an operation of a key, among the plurality of keys, by a user in a timing corresponding to a note in the musical piece;

retrieving the musical piece data of the musical piece from the memory and determining whether the musical piece data contains data of a lyric;

when the musical piece data does not contain the data of the lyric, causing data of a musical instrument sound having a pitch specified by said operated key to be generated in response to the operation of the key, and causing the musical instrument sound to be audibly output; and when the musical piece data contains the data of the lyric, and if said note in the musical piece is accompanied by a part of the lyric, causing data of a singing voice sound having the pitch specified by said operated key to be generated in accordance with the part of the lyric in response to the operation of the key, and causing the singing voice sound to be audibly output.

* * * * *